US006439936B1

(12) United States Patent
Dreith et al.

(10) Patent No.: US 6,439,936 B1
(45) Date of Patent: Aug. 27, 2002

(54) HIGH RETRACTION MARINE THRUSTER

(75) Inventors: Mark William Dreith, Houston; Darryl Scott Brittin, Katy, both of TX (US)

(73) Assignee: Global Marine, Inc., Houston, TX (US)

( * ) Notice: Subject to any disclaimer, the term of this patent is extended or adjusted under 35 U.S.C. 154(b) by 0 days.

(21) Appl. No.: 09/914,481

(22) PCT Filed: Feb. 29, 2000

(86) PCT No.: PCT/US00/05273

§ 371 (c)(1),
(2), (4) Date: Aug. 28, 2001

(87) PCT Pub. No.: WO00/51884

PCT Pub. Date: Sep. 8, 2000

(51) Int. Cl.[7] ..... B63H 5/125
(52) U.S. Cl. ..... 440/54; 114/144 B
(58) Field of Search ..... 440/54; 114/144 B

(56) References Cited

U.S. PATENT DOCUMENTS 800,184 A 9/1905 Stola ..... 440/54
1,364,961 A * 1/1921 Thompson ..... 114/163
2,885,990 A 5/1959 Hawthorne

* cited by examiner

*Primary Examiner*—Jesus D. Sotelo
(74) *Attorney, Agent, or Firm*—Christie, Parker & Hale, LLP

(57) ABSTRACT

A floating marine structure, such as a drillship (10) includes at least one thruster (14, e.g.) which includes a thruster head (22) having a propeller (102) which is adjustable to vary the angular relation to the drillship hull (11) of the horizontal direction of thrust produced by operation of the thruster. The thruster includes an enclosure (23) above the propeller for a propeller drive motor (49). The thruster has a deployed position in which the propeller (102) is submerged below adjacent exterior surfaces of the hull. The thruster is retractable vertically into the hull to retracted position where the propeller is below the floating waterline (50) of the hull. Further, the thruster has a more elevated service position to which the thruster is movable vertically from its retracted position. At the service position, the propeller (102) is accessible at a location above the floating waterline so that maintenance and repair of the thruster can be performed efficiently and the thruster can be returned quickly to its deployed position.

55 Claims, 37 Drawing Sheets

HIGH RETRACTION MARINE THRUSTER

This application claims the benefit of provisional application 60/121,812 filed Mar. 3, 1999.

FIELD OF THE INVENTION

This invention pertains to mounting of retractable propulsive and station-keeping marine thrusters in a vessel hull. More particularly, it pertains to such mountings which provide deployed, retracted, and elevated (service or maintenance) positions of a thruster and its equipment canister relative to a vessel hull.

BACKGROUND OF THE INVENTION

The worldwide search for oil and gas is extending farther and farther offshore from land. That search includes the drilling of exploratory and of production wells in the sea floor at locations of greater and greater depth. Wells now are being drilled in water depths which are sufficiently great that it is impractical, sometimes impossible, to use mooring systems to hold a floating drilling facility in place on the water surface over the well location.

Drillships (i.e., vessels of generally conventional ship form, overall hull configuration) are a common type of floating drilling facility and are preferred over other types of facilities for the drilling of wells in great water depths. It is known to equip drillships with devices known as thrusters for maneuvering and for station-keeping of the vessel. Thrusters include propellers which are operated to create thrust forces which are applied to the vessel for movement of the vessel in desired directions. In a tunnel thruster, the propeller is located in a tunnel which extends transversely through the vessel below its waterline, usually near the bow or the stern of the vessel. Tunnel thrusters are used in combination with the conventional fixed axis propulsive propellers at the stem of the vessel to adjust and to maintain the heading and the position of the vessel over a well site on the sea floor. Retractable and steerable thrusters also are known in the context of drillships and other floating drilling facilities. Whereas tunnel thrusters apply thrust reaction forces to a vessel only in one or the other of two opposite directions transversely of the vessel hull, steerable thrusters apply thrust reaction forces in any desired horizontal direction relative to the hull. For that reason, steerable thrusters are increasingly preferred for station keeping of deep water drillships.

Drillships commonly are owned by firms separate from the firms (oil companies) which have rights to drill subsea wells. Drillships, therefore, are leased or chartered by their owners and operators to oil companies. The daily lease or charter fees for drillships are called day rates and they are increasingly substantial. Therefore, it is very important to the oil companies which pay day rates that a drillship be effectively useable as much as possible in well drilling operations during the course of a lease or charter. That means that it is very important that a modern drillship be able to maintain its position over a submerged well site through a wide range of sea and weather conditions. Conditions and events which require a thruster to be shut down are to be avoided or minimized.

Thrusters, of whichever kind, are the most significant source of vessel downtime, often requiring shipyard and dry dock time to repair. Weather related up time is directly related to, among other things, the amount of power a vessel is able to put into its station keeping system. Thus, the unavailability of a thruster in a deep water drillship's station keeping system meaningfully reduces the ability of the vessel to support drilling operations as weather conditions become more severe within the design range of weather conditions.

Thruster seal arrangements have not changed significantly over the years. When shaft seals begin to leak, there are environmental as well as mechanical considerations that must be addressed. Generally, when a shaft seal begins to leak, the thruster is shut down to minimize any possible impact to the environment, and to prevent any potential mechanical damage to the thrusters due to loss of lubricating oil. Based on standard configurations for azimuthing (steerable) thrusters, repair of a leaking shaft seal requires the vessel to be moved off of its desired location and into sheltered waters for the keel haul removal of the thruster. In the case of a tunnel thruster, the repair requires extensive diver work or, worse, the dry docking of the vessel.

It will be seen, therefore, that efficient and economical operation of a modem deep water drillship which incorporates thrusters into its dynamic positioning (station keeping) system long has presented a need for innovative structural arrangements and procedures which permit a thruster to be maintained and repaired quickly and safely without moving the vessel from its desired operational location. This invention meaningfully addresses that need in the context of azimuthing (steerable) thrusters.

SUMMARY OF THE INVENTION

This invention beneficially addresses the need noted above by providing structures and procedures which enable a steerable thruster to be raised in a vessel hull from a deployed position of the thruster propeller below the hull, through a retracted position within the hull, to an elevated and dry maintenance, service and repair position. In the maintenance, service and repair position, all components of the thruster, notably its propeller and adjacent gear drive mechanism, are located above the waterline at which the hull floats. The thruster assembly preferably is movable vertically in a cooperating trunk passage in the hull and is moved in the trunk by a drive mechanism coupled between the thruster and the hull structure. As a consequence, the thruster is conveniently, quickly and safely repairable aboard the vessel. Practice of the invention reduces the duration of downtime of a thruster and maximizes the ability of the vessel to maintain station over a desired subsea location through the design range of weather conditions.

DESCRIPTION OF THE DRAWINGS

The above-mentioned and other features of this invention are more fully set forth in the following detailed description of presently preferred and other structures and procedures which implement this invention. That description is presented with reference to the accompanying drawings in which.

DETAILED DESCRIPTION OF THE INVENTION

Figure 1:
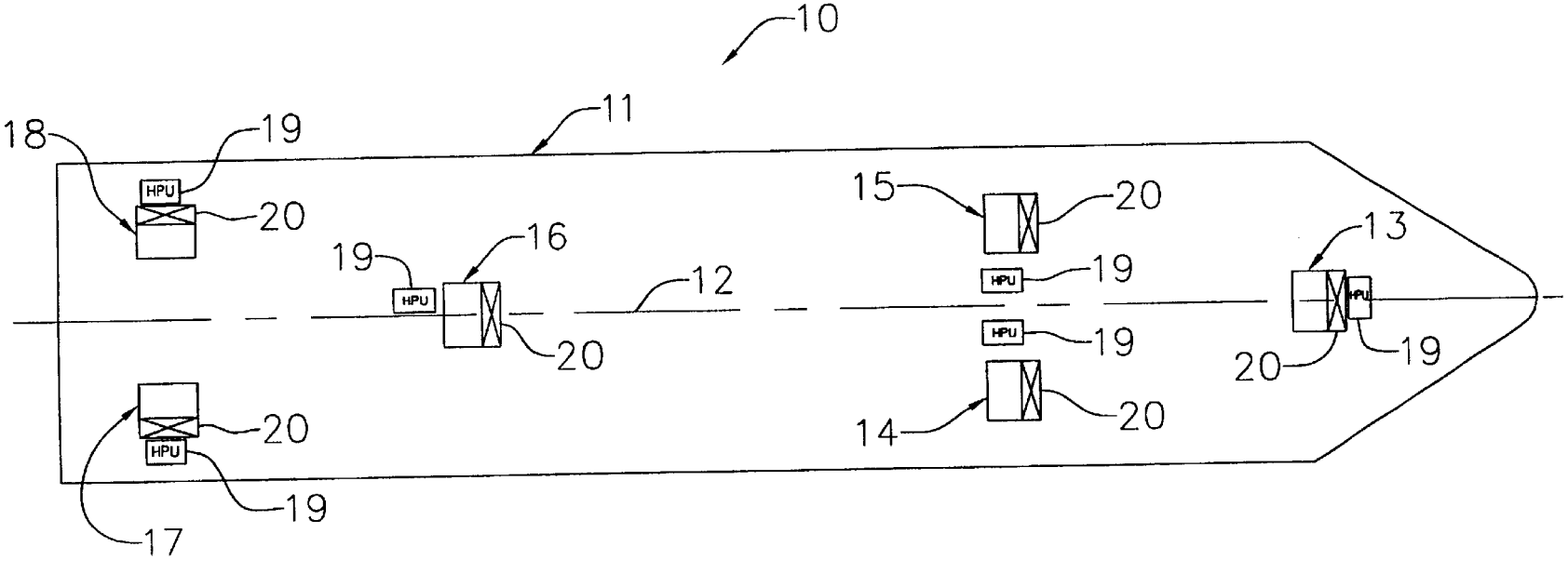
FIG. 1 is a schematic plan view of the hull of a deep water drillship which incorporates six steerable and retractable thrusters as components of its propulsion and dynamic positioning (station keeping) Systems.

FIG. 1 is a top plan view of a deep water drillship 10 having a ship-shape hull 11. The hull has a longitudinal center line 12 relative to which six retractable and steerable "L-drive" thruster assemblies 13–18 are symmetrically disposed. The thrusters are components of propulsion and dynamic positioning systems of the drillship. Aftmost thrusters 17 and 18 are principally components of the vessel propulsion system that also can be used as components of the dynamic positioning system. Thrusters 13–16, on the other hand, are principally components of the vessel's dynamic positioning system but can be used as needed as part of the propulsion system to augment the operation of thrusters 17 and 18. The vessel's propulsion system is used for moving the vessel in transit from place to place, whereas the dynamic positioning system of the vessel is used for station keeping, i.e., for holding the vessel within desired limits over a particular subsea location and for establishing and maintaining desired headings of the vessel while keeping station over that location. Each of thrusters 13–18 has associated with it a hydraulic power unit 19, and also a repair, service and maintenance area or space 20 within upper portions of the hull.

Figure 2:
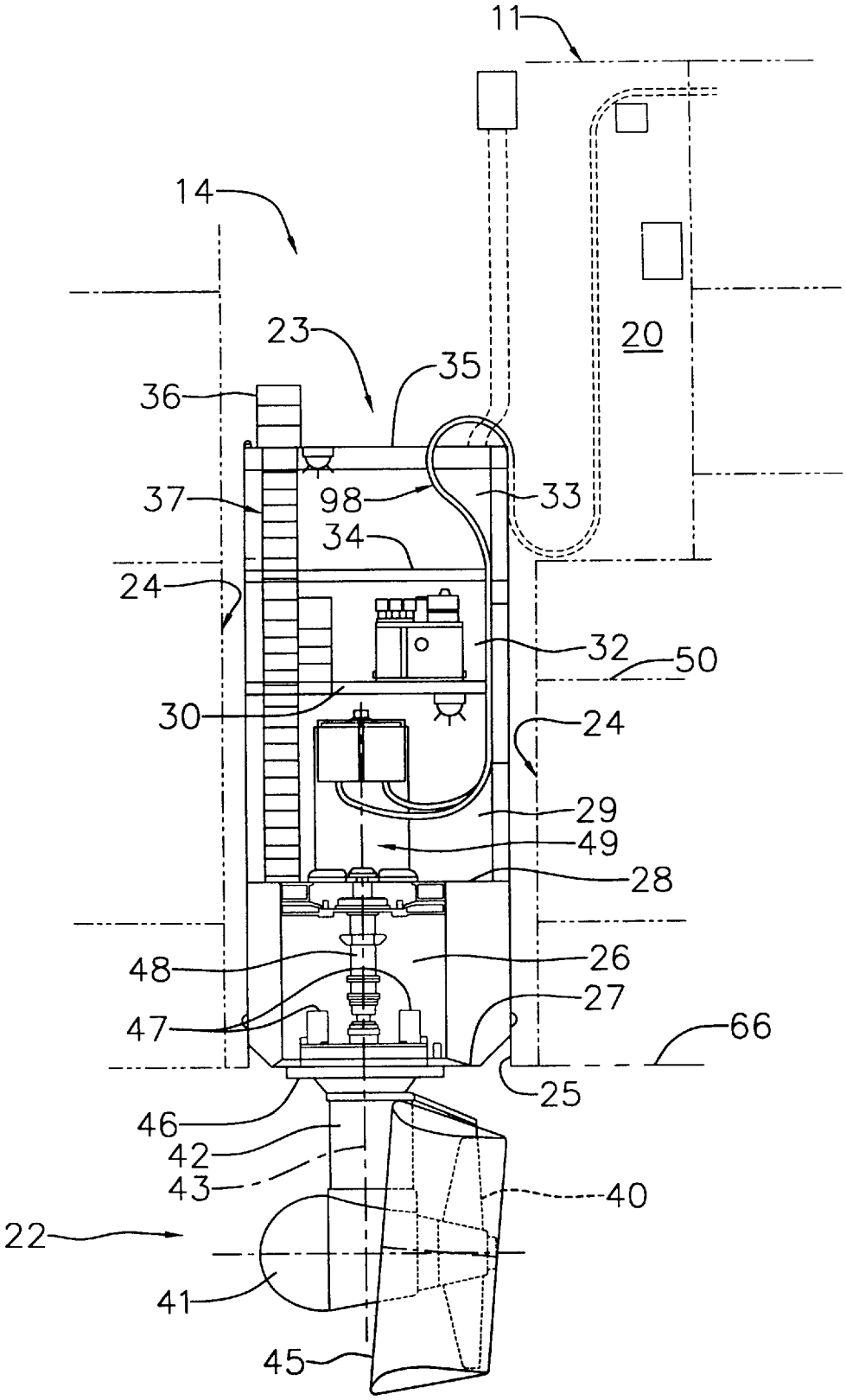
FIG. 2 is a cross-sectional elevation view of a station keeping thruster illustrated in its deployed (lowermost) position relative to the structure of the vessel which is shown in phantom lines in FIG. 2.
Figure 3:
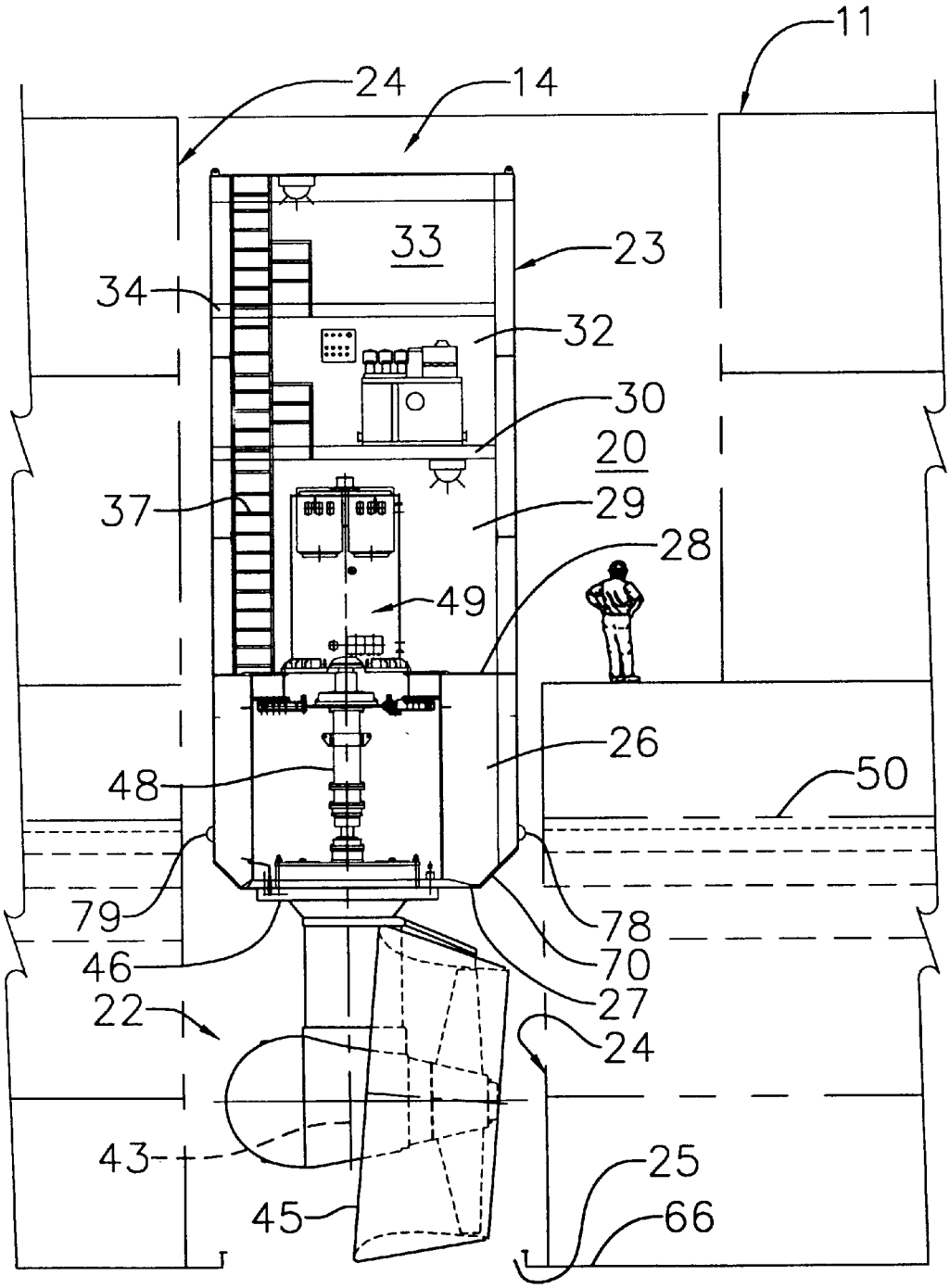
FIG. 3 is a cross-sectional elevation view similar to that of FIG. 2 showing the thruster in its retracted (intermediate) position in which the lower extremity of the thruster structure is located the molded surfaces of the hull above its baseline or keel.
Figure 4:
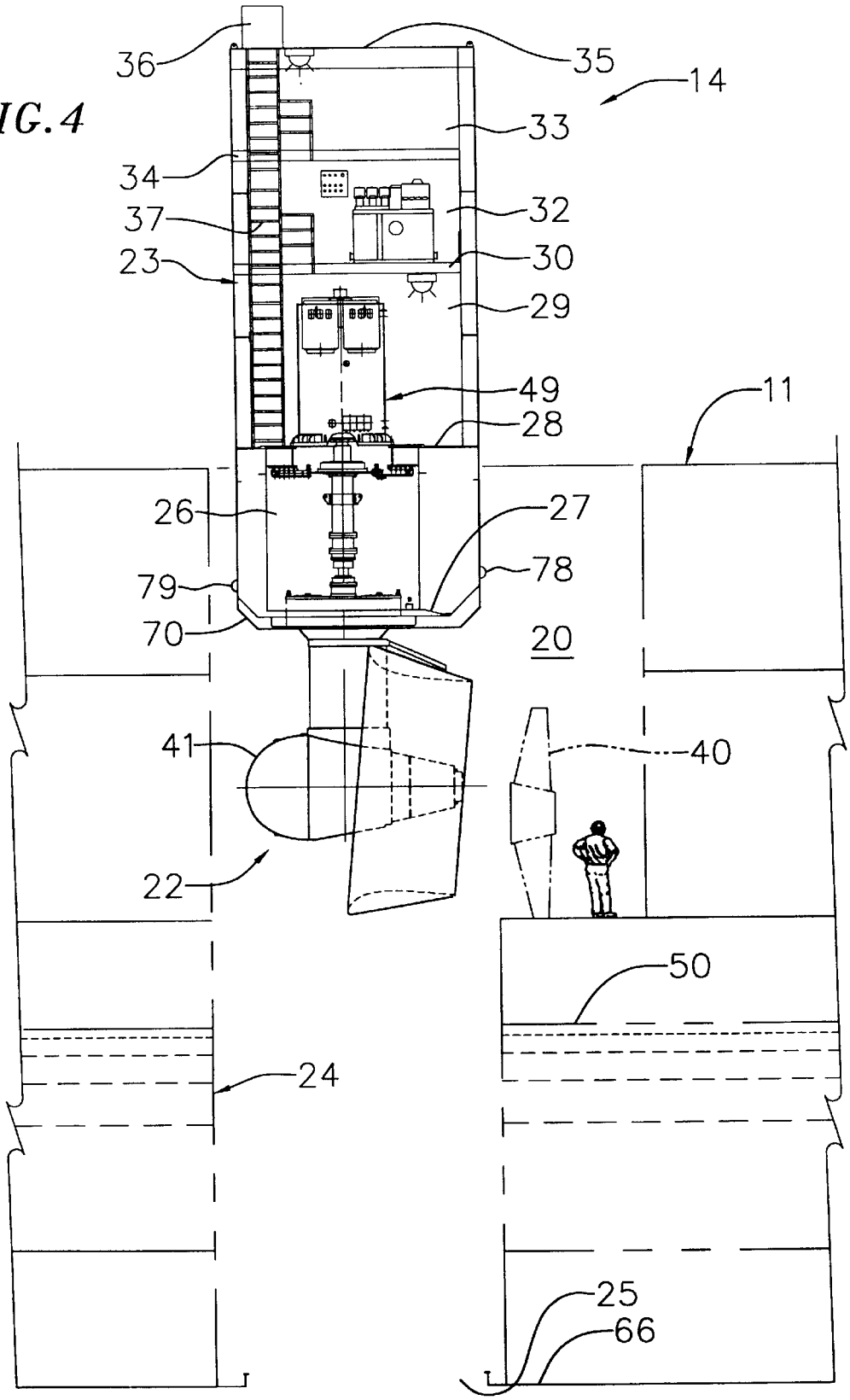
FIG. 4 is a cross-sectional elevation view, generally similar to those of FIGS. 2 and 3, showing the thruster in its uppermost repair, service and maintenance position in which the lower extremity of the thruster is placed above the operating draft waterline of the vessel.
Figure 5:
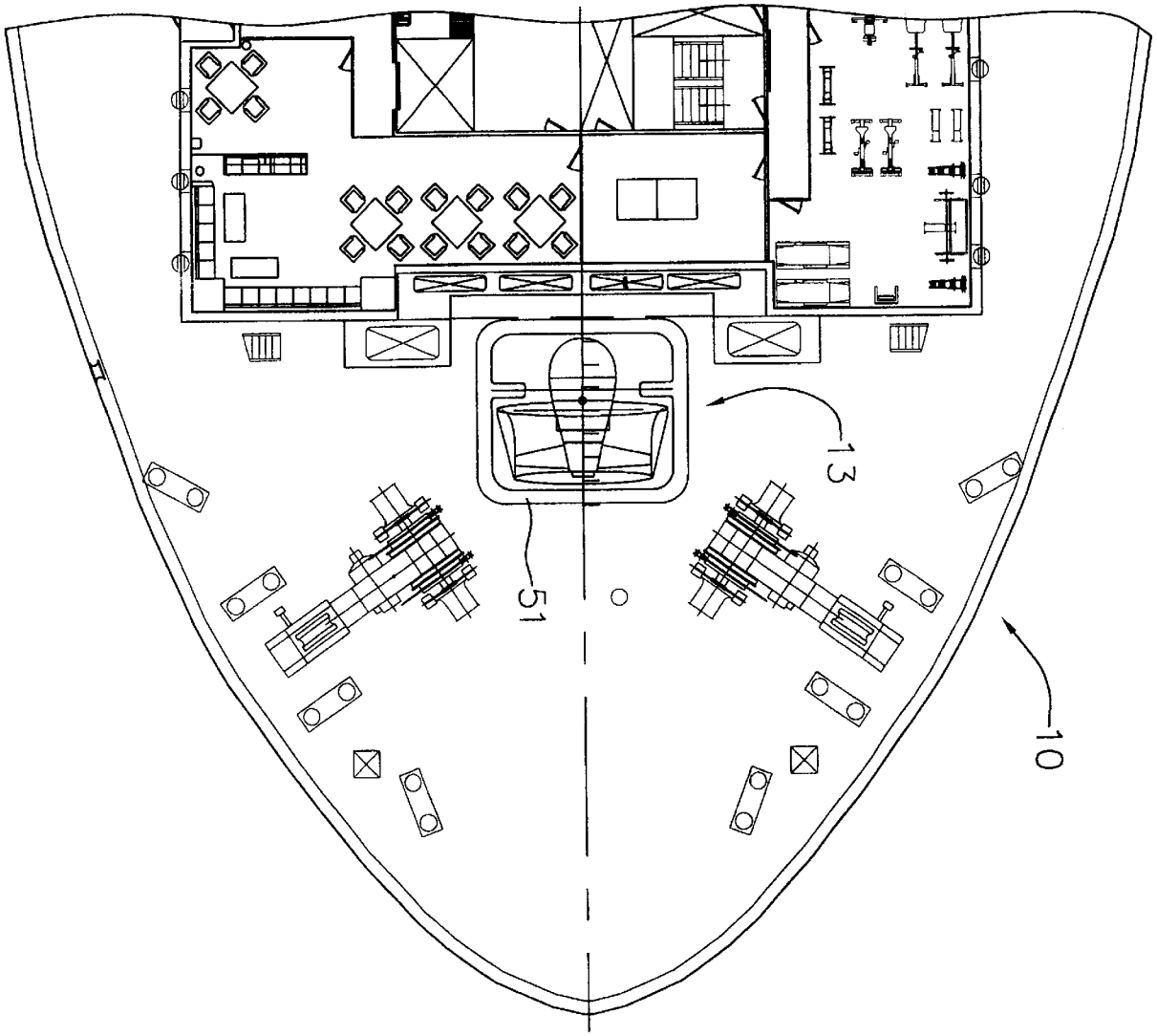
FIG. 5 is a plant view of the foredeck area of the drillship and illustrates the arrangement of the most forward thruster and its trunk relative to the vessel hull on its centerline.

FIGS. 2, 3 and 4 illustrate thruster assembly 14 in its deployed, retracted and elevated positions, respectively, in hull 11. Those separate vertical positions of thruster assembly 14 in the hull are provided by operation of a thruster vertical travel system which is effectively coupled between the hull and the thruster and which is operable for moving the thruster vertically to and between those positions. As described more fully below, the presently preferred form of thruster vertical travel system is a rack and pinion drive defined between trunk 24 and thruster canister The illustrations of FIGS. 2, 3 and 4 are also pertinent to thrusters assemblies 13, 15 and 16 and also, to a lesser extent, to thrusters 17 and 18. FIG. 4, for example, shows that the thruster is composed of a thruster head assembly 22 which extends below and is carried by the lower end of a cylindrical thruster canister 23; a cylinder is not required to have a circular transverse shape. The canister is an enclosure for a driver for the propeller of the thruster. The thruster canister is located in a vertical watertight trunk 24 which has an opening 25 at its lower end through the hull essentially at the hull keel or baseplane. As shown in FIG. 5, for example, each thruster canister and the cooperating trunk are substantially rectangular in planview. The canister has a lower compartment 26 which has a bottom floor 27 and a first intermediate deck 28 defining the upper end of that compartment. Deck 28 forms the bottom end of a driver compartment 29 which has a second intermediate deck 30 at its upper end. An ancillary equipment compartment 32 is located immediately above deck 30 and is separated in the canister from an upper compartment 33 by a further deck 34. The upper end of the canister is defined by a top deck 35. A closable access trunk 36 affords ingress and egress to and from canister 23 and connects to stairs and ladders 37 within the canister.

The thruster head assembly 22 includes a propeller 40 (see FIG. 2) which, as preferred, is removably mounted on a propeller shaft (not shown) which is the output shaft of a right-angled drive gear box (not shown) housed within a hub 41 carried at the lower end of a vertical shaft housing 42 which is rotatable about a vertical axis 43 along which is aligned the input shaft to the right angle gear drive within hub 41. The thruster preferably is of the Kort nozzle type and so propeller 40 rotates within the interior of a circular nozzle shroud 45 which is also a component of the thruster head assembly. The thruster head shaft housing 42 is rotatably mounted at its upper end by a suitable thrust and rotary bearing assembly 46 which is carried at the bottom of the thruster canister. A planetary-type gear drive 47 and suitable motors for operating the same are located in canister compartment 26; they are operable for rotating head assembly as desired about axis 43 to vary the angular relation of the axis of the propeller 40 relative to the hull. That is, drive 47 is a component of a steering mechanism which is operable for changing the angular relation between the direction of thrust produced by operation of the thruster and the hull of the vessel. Other components of the thruster assembly located within compartment 26 are an inboard drive shaft 48, a flexible coupling, and a brake. The steering mechanism within the canister is operative to rotate the thruster head as many times as may be desired through an arc of 360° about vertical steering axis 43.

The thruster head commonly is bolted to the bottom structure of the thruster canister.

A propeller driver motor 49 is located in engine compartment 29. The motor preferably is of the vertical axis type and is aligned along the steering axis 43 of the thruster head. More preferably, motor 49 is an electric motor which preferably is of the variable frequency, variable speed type. The preferred power rating of motor 49 is 5 megawatts. Motors of other kinds or of different power ratings can be used. Also, propeller drivers other than electric motors can be used in the practice of this invention.

As noted above, FIG. 2 shows thruster assembly 14 in its deployed or lowermost position vertically relative to hull 11. In that position of the thruster assembly, the bottom floor 27 of the thruster canister is substantially coplanar with the vessel base plane 66 and the thruster head 22 is disposed entirely below the hull. The shaft seals, which are subject to the leakage problems described above, are located in hub 41 of the right angle drive. The operating draft level, i.e., load waterline 50, of drillship 10 is shown in FIGS. 2, 3 and 4. When the thruster assembly is disposed in its deployed position, the central intermediate deck 30 of the thruster canister is located at about the vessel load waterline 50 in the implementation of this invention depicted in FIGS. 2, 3 and 4. Accordingly, the thruster canister, at least from its bottom floor 27 to a location above central intermediate deck 30, is watertight or substantially so. It will be appreciated that, in view of the structures which extend through the bottom and sides of the canister in the lower portions of the canister, some leakage of water into the canister from the annulus between the canister and its trunk may occur. Accordingly, the lower compartment of the canister preferably includes bilge pumps which are operated to remove such leakage water from the interior of the canister.

FIG. 3 shows thruster assembly 14 in its retracted position within hull 11. In that position, the lower extremity of the thruster head, notably the lower extent of Kort-nozzle shroud 45 is located above the vessel base plane. In that position of the thruster, the bottom 27 of canister 23 is located below the ship's load waterline 50 and so the portion of the trunk below that level of the hull is fully flooded. Access to the lower portion of the canister trunk, principally through hull opening 25 by divers, is both limited and extremely hazardous.

As noted above, it has long been known to provide vertically moveable retractable and steerable thrusters in drillships and other kinds of vessels. Those known arrangements afford vertical motion of the thruster head into and between the two positions shown in FIGS. 2 and 3, namely, the deployed and retracted positions of the thruster head. In both of those positions, the thruster head is fully submerged either below the vessel or within the lower portions of the open-bottom trunk in which the thruster canister is moveably mounted. It is not heretofore been known or suggested that a steerable thruster can or should have any higher position in the vessel for any useful purpose, especially the purpose of access to the thruster head for maintenance and repair of the head and particularly its troublesome shaft seals. Accordingly, FIG. 4 illustrates an important feature of this invention. That feature is the vertical moveability of the thruster canister in the vessel hull to an elevated service position above the merely retracted position of the thruster head. In that elevated position the thruster head is located above the load waterline 50 of the vessel and so is dry within trunk 24. In that elevated position, the thruster head is located within the height of the service repair and maintenance space 20 which is provided as a lateral extension, preferably in one direction, of canister trunk 24. In the preferred embodiment of the invention illustrated in FIG. 4, space 20 preferably is provided forward from the trunks of thrusters 13, 14, 15 and 16 between the lower tweendeck and the main deck of the vessel. As shown in FIG. 1, for example, spaces 20 for stem thrusters 17 and 18 preferably are provided to the outboard sides of those canister trunks.

It will be noted from an inspection of FIGS. 3 and 4 that, when the thruster assembly is in its upper-most elevated repair and maintenance position, the upper portions of the thruster canister extend above the main deck of the vessel hull. As shown in FIG. 5, for example, at the vessel main or other weather deck the thruster trunk includes a hatch coaming 51 which surrounds an opening in that deck adequate in size and configuration to enable the upper portion of the canister to project above the deck when a hinged lid or other hatch closure arrangement (not shown) has been cleared from the coaming.

Figure 6:
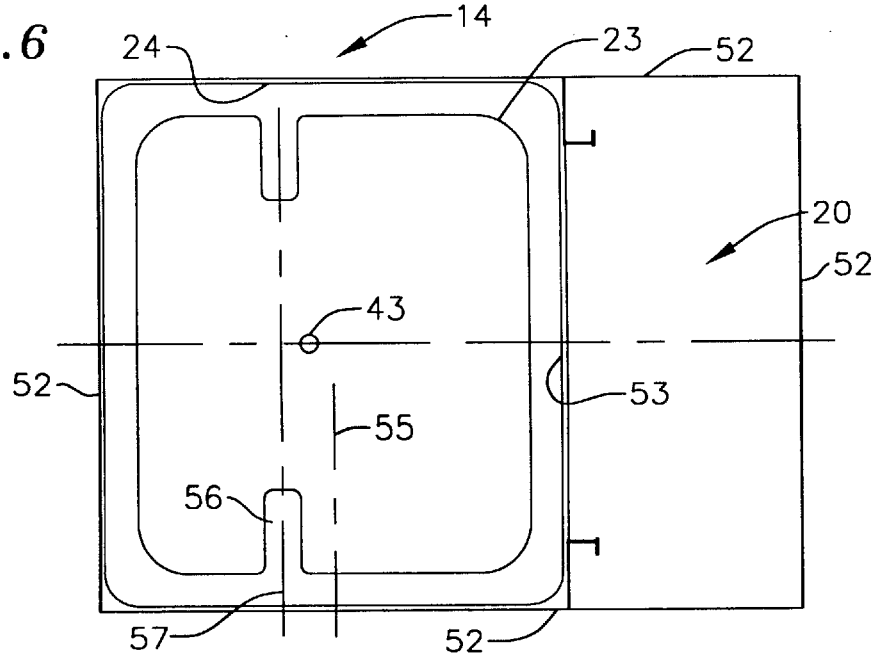
FIG. 6 is a schematic fragmentary cross-sectional plan view through a thruster trunk at a location between the lower tweendeck and main deck of the drillship.

FIG. 6 is a horizontal plan view through trunk 24 at an elevation in the trunk between the lower tweendeck and the main deck of hull 11. FIG. 6 also shows the horizontal cross-sectional outline of canister 23 within the trunk to the rear of repair and maintenance space 20. The athwartship (transverse) dimension of the thruster canister preferably is greater than its fore and aft dimension. The trunk is defined at the range of deck levels shown in FIG. 6 by forward, aft, and side bulkheads 52 and below that level by a more rearwardly forward bulkhead 53. FIG. 6 also shows that canister 23 has its own longitudinal centerplane 55 oriented (in this instance) transversely of the vessel hull. The vertical steering axis 43 of the thruster is located to the rear of centerplane 55. FIG. 6 also shows that, to the rear of steering axis 43, the port and starboard sidewalls of the canister are inwardly recessed, as at 56, at locations which are aligned with each other across the canister. The recesses 56 are centered on the vertical centerplane 57 of a rack and pinion drive mechanism which is the presently preferred form of a thruster vertical travel system which is effectively coupled between the vessel hull and the thruster for moving the thruster vertically in the trunk into and between its deployed and elevated positions within hull 11.

Figure 7:
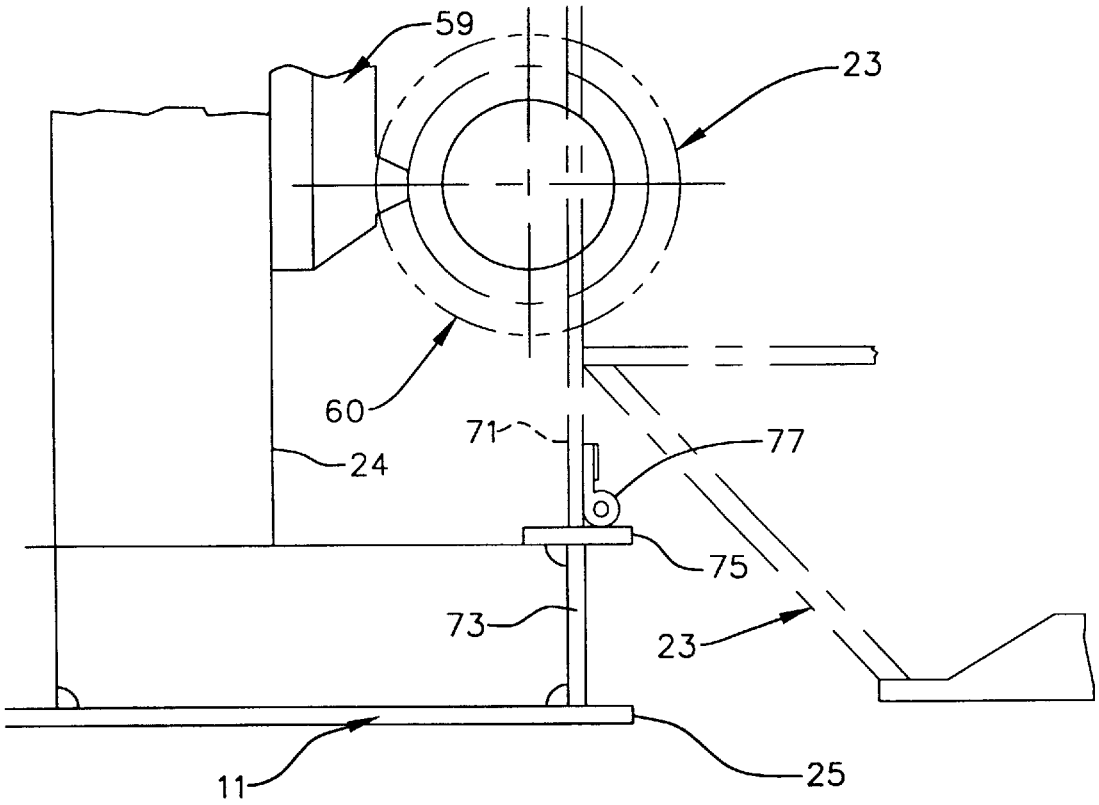
FIG. 7 is a fragmentary elevation view of the cooperation between the thruster canister and the vessel structure and illustrates the presently preferred rack and pinion drive mechanism for moving the vertically within the hull.
Figure 13:
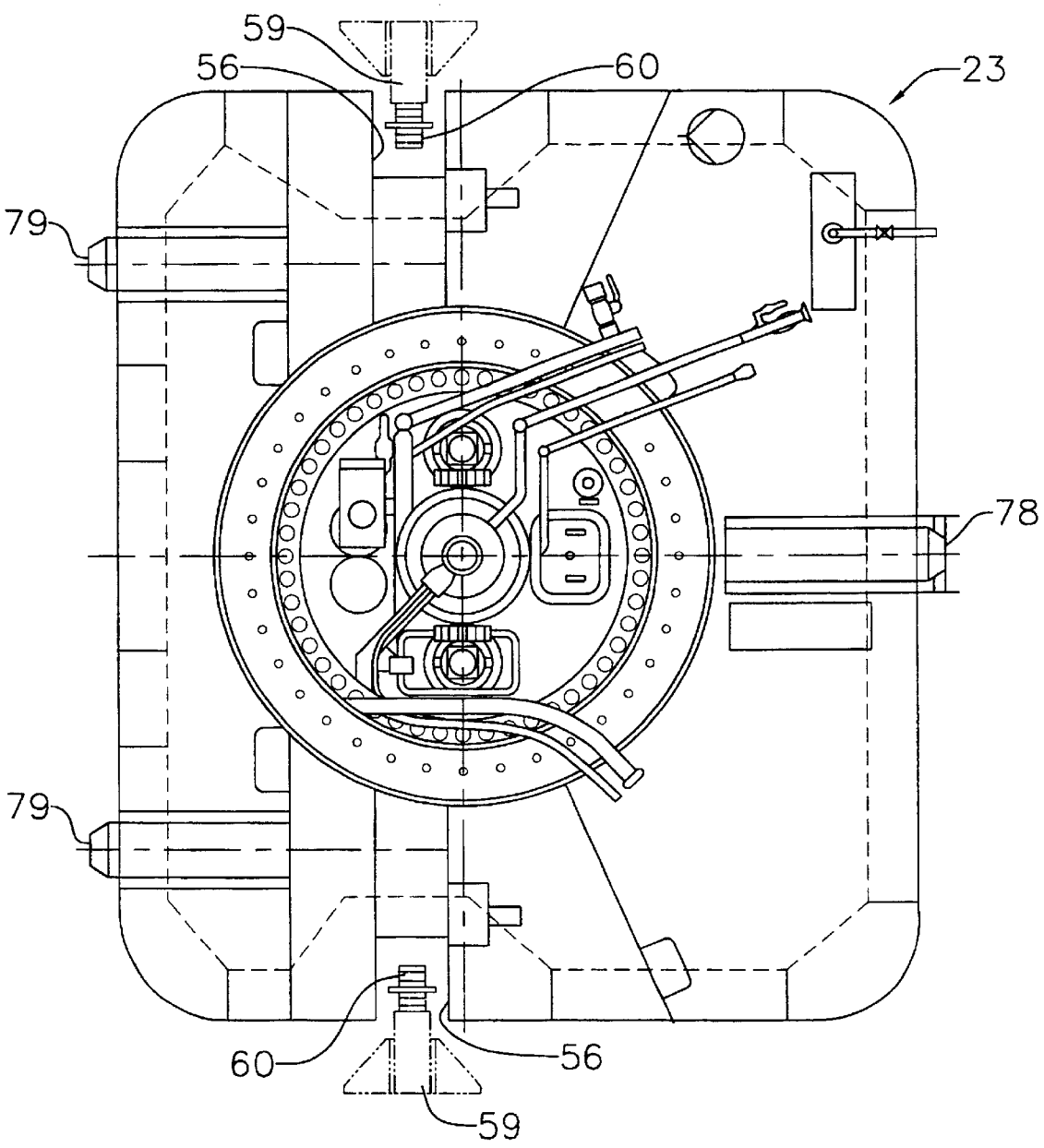
FIG. 13 is a plan view taken horizontally through the thruster canister in its bottom compartment.
Figure 14:
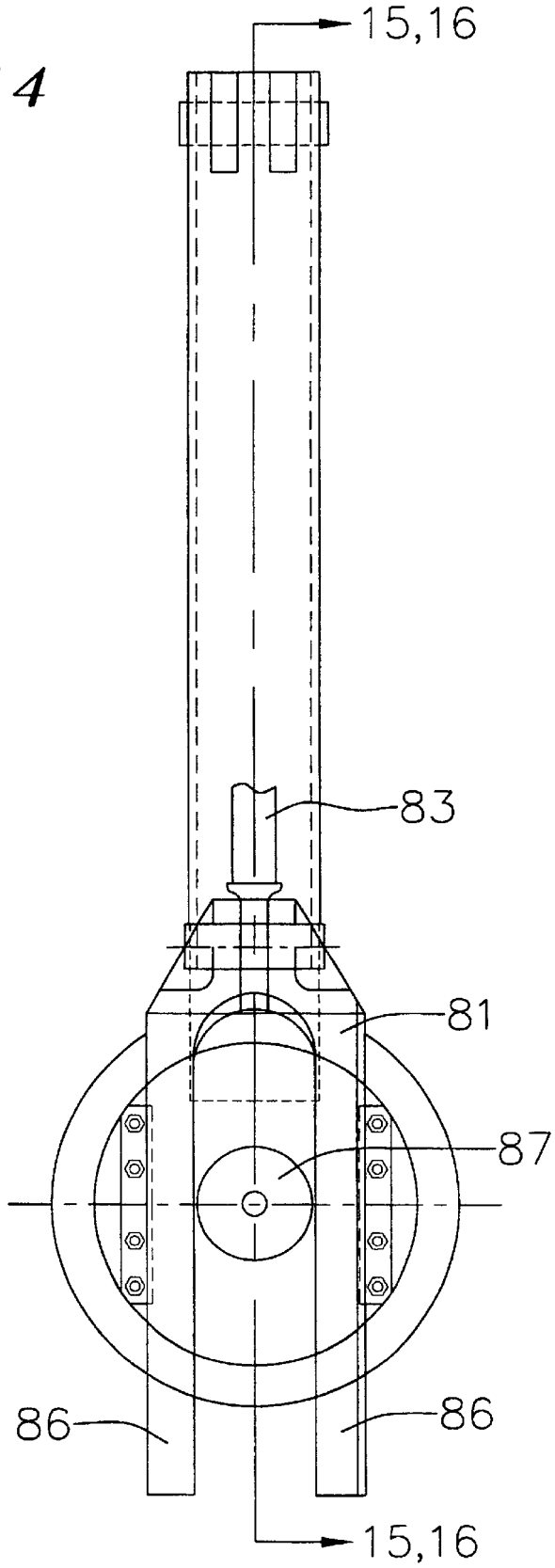
FIG. 14 is an elevation view of a retractable wedge arrangement provided to maintain canister locking pins in their positions in which they extend outwardly from the canister into sockets located in the thruster trunk.
Figure 15:
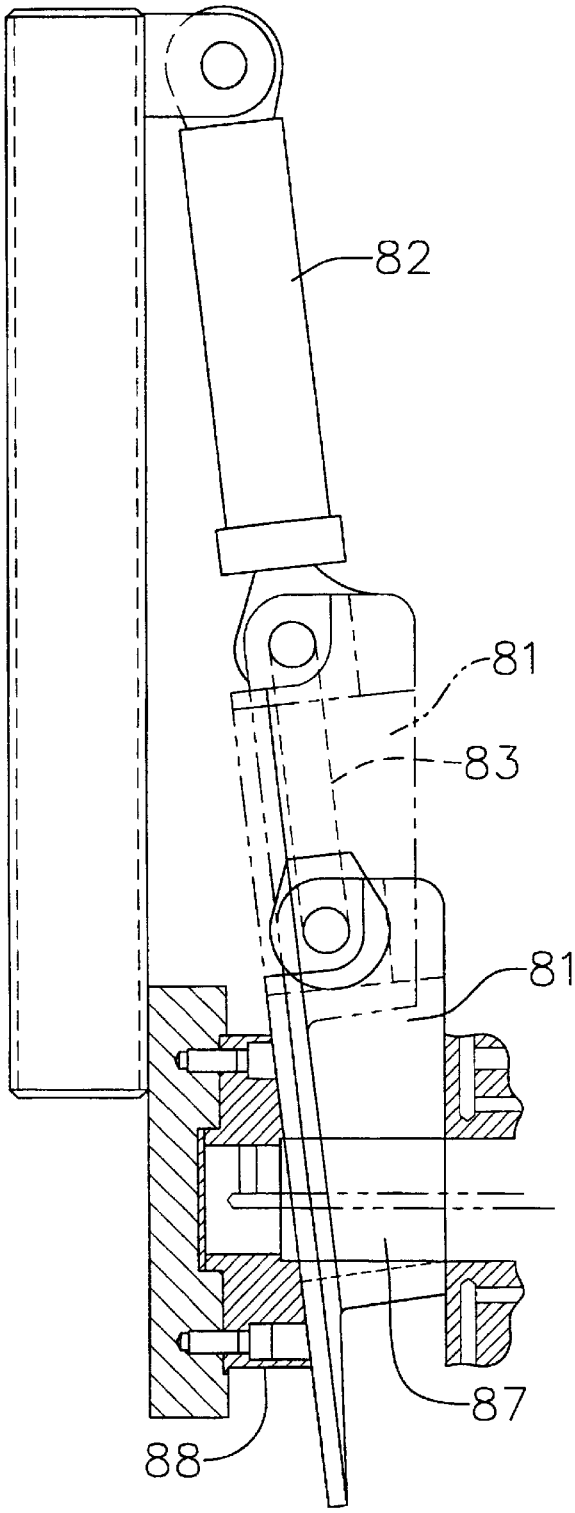
FIG. 15 is a cross-sectional elevation view taken along line 15, 16 of FIG. 14.
Figure 16:
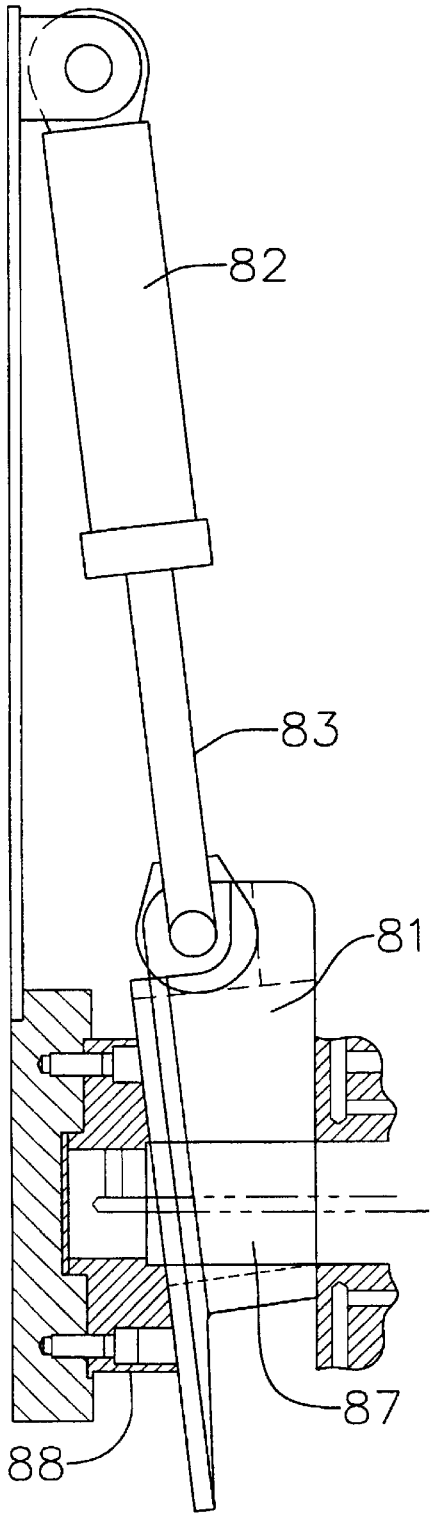
FIG. 16 is a view similar to FIG. 15 taken along line 15, 16 of FIG. 14.

Referring to FIG. 7, a pair of vertically disposed racks 59 (linear gears) are securely affixed to the hull structure, i.e., to trunk side bulkheads 52 adjacent each side of the canister path of movement. The racks are centered along rack centerplane 57 and, as depicted in FIG. 13, extend toward the adjacent recess 56. Each rack cooperates with a motor driven pinion 60 which is rotatably carried by the canister within a respective recess 56 on a drive shaft with traverses the recess. Each pinion shaft is mounted for rotation in suitable bearings within the canister adjacent to recess 56. Each pinion is driven by a hydraulic motor (not shown) located within the canister. Each pair of pinions preferably is located low in the thruster canister so that the racks may be located wholly within the canister trunk below the top of the trunk. Each canister is guided in its vertical motion within the adjacent trunk by suitable guides (not shown) connected between the canister and the trunk. Those guides may be provided by suitable vertical rails affixed to the trunk walls and cooperating with centering rollers carried on the exterior of the canister at vertically spaced locations along the exterior of the lower portion of the canister. Those guides can be associated with the forward, rear and opposite side walls of the generally rectangular canister. However, it is presently preferred to use the sides of the supports for the racks, in combination with guide shoes on the canister, as the mechanism for guiding vertical motion of the canister. The thruster racks and pinions and the drive mechanism for the pinions are generally similar to the rack and pinion drive mechanisms found in jack-up offshore drilling platforms, for example.

Figure 8:
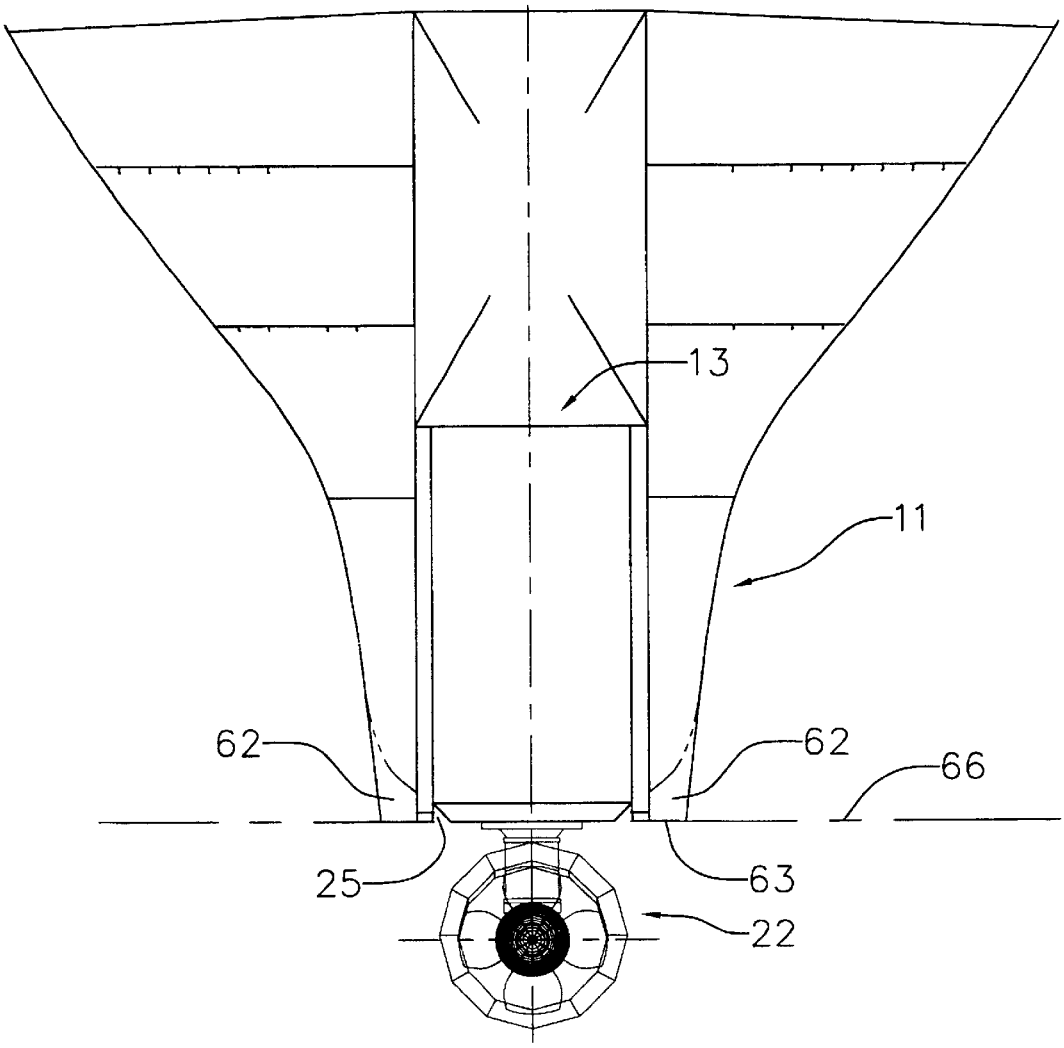
FIG. 8 a transverse cross-sectional elevation view of the hull in way of the forwardmost thruster.

It is desired that the edges of each thruster hull opening 25 be in a horizontal plane which is either in or above the hull baseplane. Thrusters 14, 15 and 16 are located in hull 11 at places below which the bottom of the hull is flat. Thrusters 13, 17 and 18, however, are located sufficiently far forward and aft, respectively, that the lines of intersection of the thruster trunks with the molded surfaces of the hull do not lie entirely in the hull baseplane or in a horizontal plane parallel to the baseplane. Therefore, as shown in FIG. 8 with respect to forward thruster assembly 13, the molded surfaces of the hull around that thruster trunk carry an appendage 62 which defines the desired horizontal flat surface 63 around trunk opening 25. The size of the forward appendage 62 is adequate to accommodate the foundations for the canister seat structure shown in FIG. 13, for example, and described below. Similarly, an appendage 64 is carried by the molded surfaces of the hull adjacent its stem around the lower extremities of the trunks for thrusters 17 and 18. Each of appendages 64 has a horizontal flat bottom surface 65 which is spaced above baseplane 66 by a distance which is substantially equal to the height of a thruster head assembly 22; see FIGS. 9 and 10.

Figure 9:
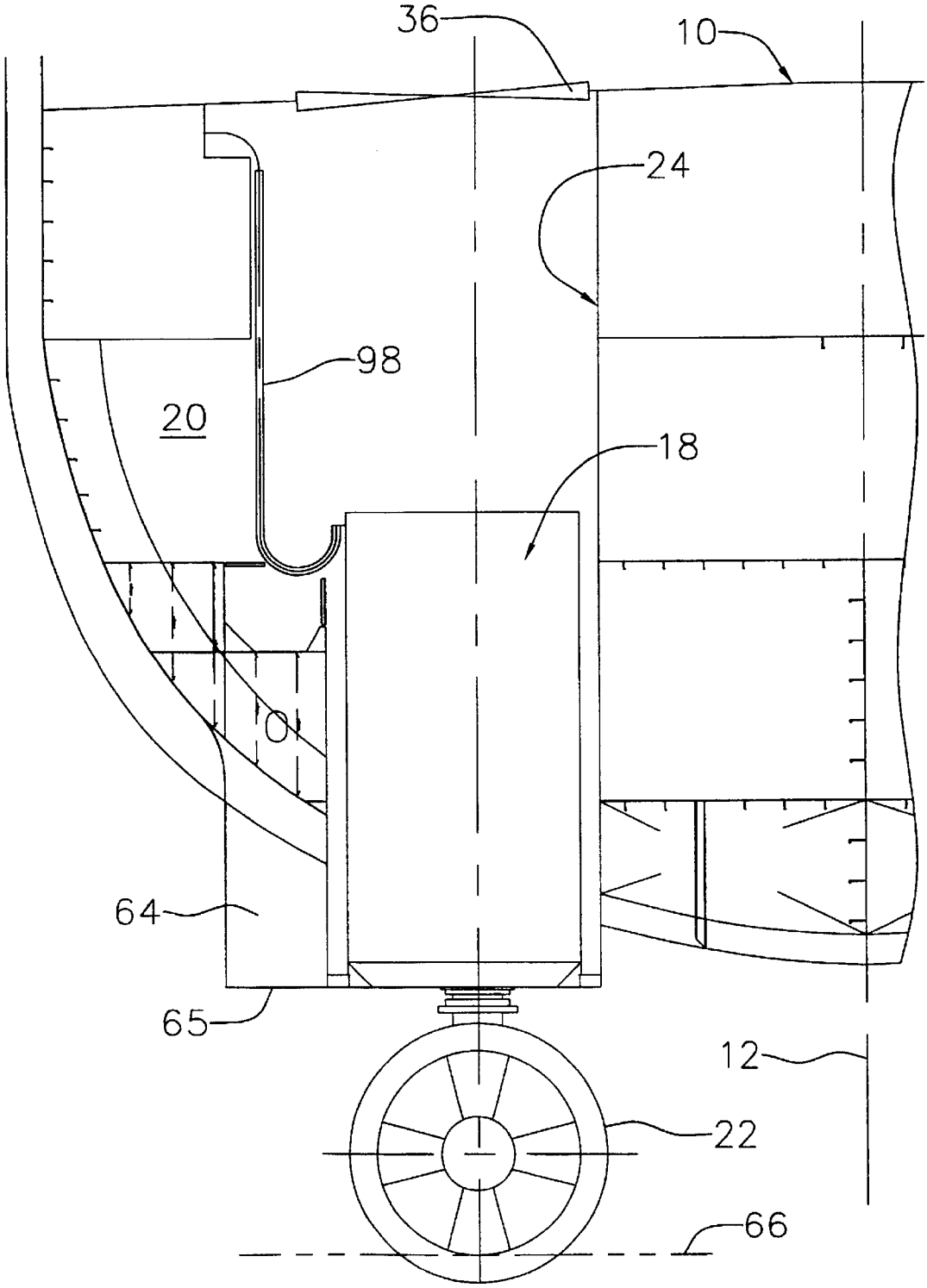
FIG. 9 is cross-sectional elevation view showing one of the two stern thrusters in its deployed position relative to the vessel hull.

FIG. 9 illustrates two principal ways in which stem thrusters 17 and 18 differ from thrusters 13–16. First, as shown in FIG. 9, the deployed position of a stem thruster 17, 18 is substantially above the hull baseplane which is represented in FIG. 9 by line 66. To the extent that any portion of the thruster head lies below baseplane 66 in the deployed position of the thruster, that extent is minimal. It will be recalled that thrusters 17 and 18 are provided in drillship 10 principally as components of the vessel propulsion system and secondarily as components of the dynamic positioning system of the vessel. Accordingly, the positions of the propellers of thrusters 17 and 18 in their deployed positions corresponds to the positions of propellers on the rear ends of shafts having axes which are fixed to the vessel hull. For that reason, thrusters 17 and 18 are used for shallow water maneuvering of the vessel.

Another principal difference of thrusters 17 and I 8 from thrusters 13–16, shown in FIG. 1, is that, in effect, the canisters and trunks for thrusters 17 and 18 are rotated 90° in opposite directions about vertical axes relative to the corresponding structural features for thrusters 13–16. As noted above, the repair and maintenance space 20 for each of the stern thrusters is located outboard from the adjacent trunk. The racks provided for vertical movement of the stern canisters in their trunks are carried on the forward and aft bulkheads for those trunks. In all other significant respects, the other descriptions of this invention pertinent to thrusters 13–16 are also applicable to thrusters 17 and 18.

Figure 10:
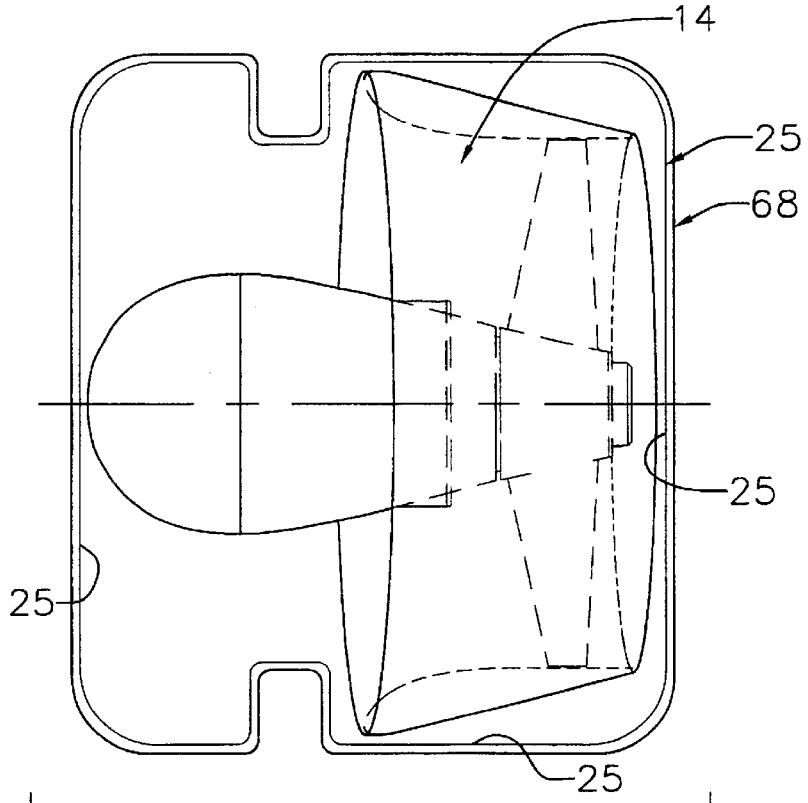
FIG. 10 is a fragmentary plan view of a thruster and shows the relationship of the thruster-hull seal relative to the hull opening for the thruster.

In FIG. 10 the perimeter of a typical trunk bottom opening 25 is shown in plan view. Parallel to that perimeter and just outwardly from it, line 68 in FIG. 10 represents the seat and seal line of the thruster canister with its seat and support structure around the perimeter of the hull opening. That seat and support structure 69 preferably is defined as an inner frame around trunk bottom opening 25 and is shown in more detail in the plan view of FIG. 11 in which the inner edge of the seat structure corresponds to the perimeter of hull opening 25; see also FIG. 12.

Figure 11:
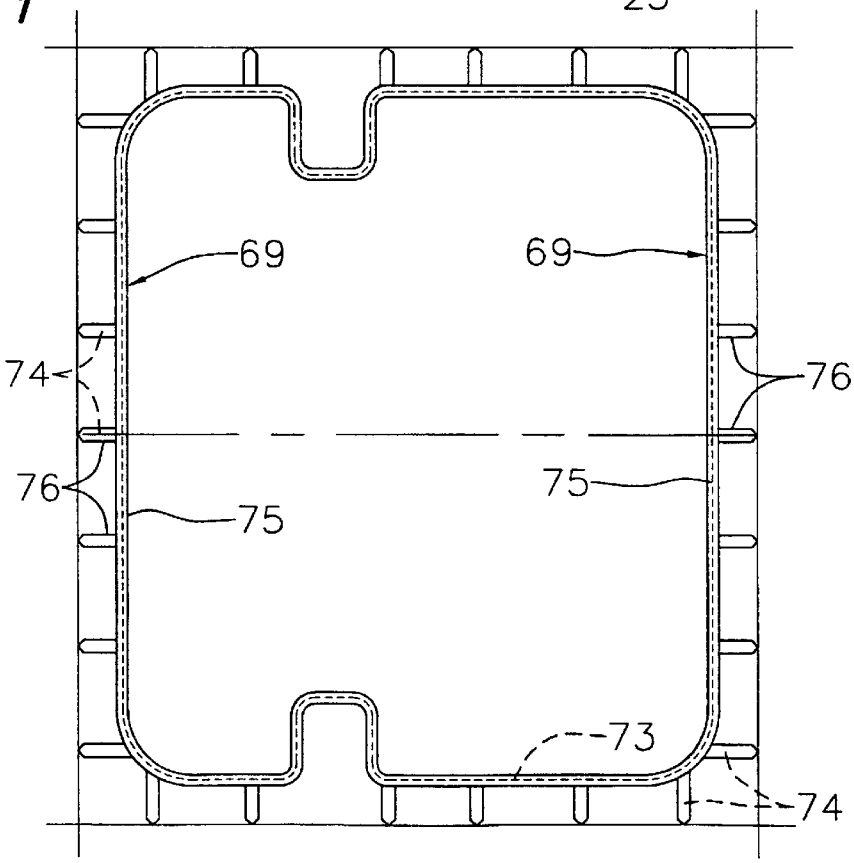
FIG. 11 is a plan view of the structural seat for the thruster canister in the deployed position of the thruster.
Figure 12:
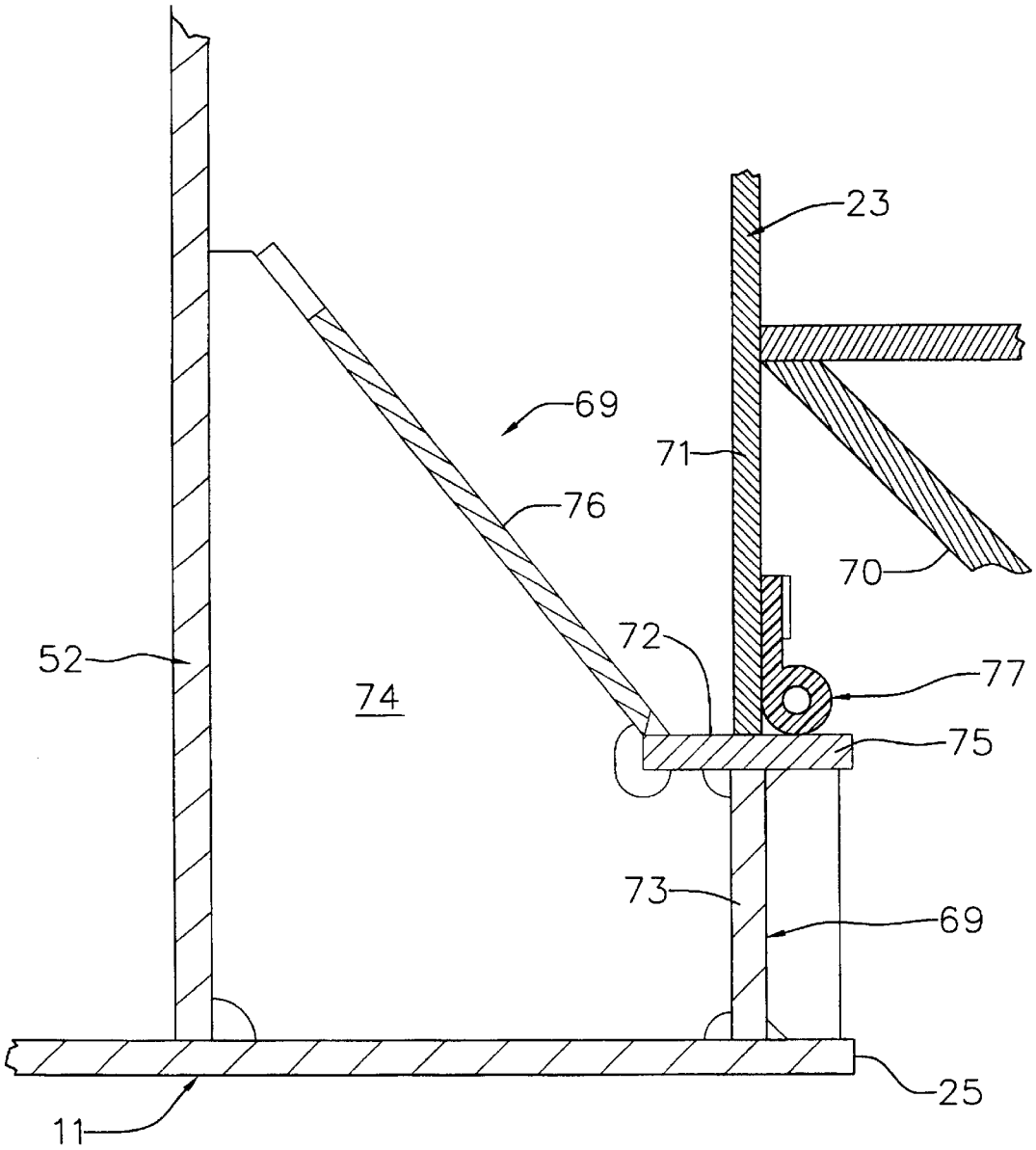
FIG. 12 is a cross-sectional elevation view of a thruster canister as engaged with its seat and illustrates the seal arrangement which is effective between the thruster and the hull in the deployed position of the thruster.

As shown in FIGS. 2, 3 and 4, for example, each thruster canister preferably has a frustoconical lower end configuration in which the canister has a downwardly and outwardly facing conical surface 70. As shown in FIG. 12, the vertical walls of the thruster canister are extended below the upper end of surface 70 to form a cylindrical skirt 71 which has a lower edge 72 which preferably is disposed in a single horizontal plane perpendicular to the height of the canister. Each canister skirt 71 is aligned with a vertical foundation and coaming plate 73; see FIG. 12. Each plate 73 is affixed to the upper surface of the hull bottom plating either in the hull per se or in the forward and aft hull appendages 62 and 64. That is, the center of plate 73 at all locations around the perimeter of the adjacent hull opening 25 corresponds to line 68 shown in FIG. 10. At periodic locations around the perimeter of the hull opening, plate 73 is laterally braced by brackets 74 connected to plate 73, to the hull plating and to adjacent trunk bulkhead 52, all as shown in FIG. 12. A horizontal seat plate 75 is carried on the top edge of plate 73 and extends continuously around the trunk with its inner edge disposed directly above perimeter of hull bottom opening 25 as shown in FIG. 12. Seat plate 75 extends laterally in opposite directions from the top of plate 73. The canister seat and foundation structure is further strengthened and stiffened by the presence of face plates 76 along the upper edges of brackets 74 as shown in FIGS. 11 and 12. As shown in FIG. 11, the canister seat and foundation structure has features which correspond to recesses 56 of each canister.

FIG. 12 also illustrates a preferred arrangement according to this invention in which a resilient seal member 77, preferably made of a suitable polymeric material, is carried around the inner surface of the canister skirt 71 for bearing against both the inner surface of the canister skirt and the top surface of seat member 75 when canister 23 is engaged with and supported on its seat and foundation structure 69 as shown in FIG. 12. It will be appreciated that when seal member 77 is engaged with the canister skirt and seat member 75, a lowering of hydrostatic pressure within the annulus between canister 23 and the adjacent trunk walls, relative to water pressure in the trunk below the canister, will cause the seal to be forcibly engaged with the canister skirt and seat member surfaces. Accordingly, that annular space between a seated canister and the trunk walls can be pumped out, as by use of pumps in the hull or in the canister, as desired, to cause that space to be essentially dry when the thruster is in its deployed position. The existence of a water-free space around the canister in its deployed position reduces the tendency of water to leak into the canister from that annulus along the pinion shafts, the canister locking pins 78, 79 (described below) and any other structures which penetrate the side walls of the canister in those portions of the canister which are below the vessel load waterline in the deployed position of the thruster.

From an examination of FIG. 2, for example, it will be apparent that in the deployed position of the thruster, the canister extends sufficiently far below vessel load waterline 50 that the canister is positively buoyant; in the exemplary vessel depicted in the drawings, the canister reaches that buoyant state in moving from its retracted to its deployed position at about the time that the lower end of the canister is at the level of the vessel tank top shown in FIG. 2. Therefore, to place the thruster in its deployed position from its retracted position, it is necessary to drive the canister downwardly in the trunk sufficiently forcefully that the positive buoyant forces acting upwardly on the canister are overcome. Once the canister skirt engages its seat plate 75, see FIG. 12, the canister must be held against its seat and foundation against those buoyant forces. That holding function preferably is performed by a thruster position keeping system which is cooperable between the hull and the thruster and is operable for securing the thruster in its deployed position. Important components of that system are retractable locking pins which are extendible outwardly from desired locations in the canister into fitted seats or sockets which are securely fixed into the canister trunk walls at corresponding locations. It is preferred not to rely upon the rack and pinion drive mechanism to hold the canister in its deployed position against buoyant, hydrodynamic and other forces acting upwardly against the canister or against the deployed thruster head.

As shown more clearly in FIG. 13, canister 23 (as well as each of the canisters for thrusters 13, 15 and 16) has a single forward locking pin 78 which is aligned along the fore and aft vertical centerplane of the canister. Each canister also has a pair of aft locking pins 79 which are disposed at a common level in the canister and are spaced equidistantly from the canister fore and aft vertical center plane. The forward locking pin preferably is located in the canister at the same level as the aft locking pins. The forward locking pin 78 has a hydraulic bias load which is twice the bias load applied to each of aft locking pins 79. More specially, the hydraulic bias load applied to each of aft locking pins 79 is on the order of 50 tons, whereas the hydraulic bias load applied to each forward locking pins 78 is on the order of 100 tons. Thus, balanced forces are applied to the aft locking pins as a set and to the forward locking pin.

The descriptions in the preceding paragraph pertain to thrusters 13–16. As noted above, in aft thrusters 18 and 19, the thrusters are rotated 900 so that the canister wall called a front wall in any of thrusters 13–16 becomes the outboard wall of each of thrusters 18 and 19. Thus, in the aft thrusters, the forward 78 and aft 79 locking pins of thrusters 13–16 become outboard and inboard locking pins, respectively, in thrusters 18 and 19.

The several locking pins carried by each canister provide a stable three-point positive connection between the canister and the canister trunk when the canister is in its deployed position. The connection of the thruster to the vessel hull in the deployed position of each thruster is sufficiently strong and rugged that the connection can be relied on to transfer to the hull the reaction forces (thrust forces acting on the hull) produced by operation of the thruster. Those forces can act on the hull in any horizontal direction. The forceful engagement of each deployed canister with its foundation 69 at the bottom the thruster trunk also aids in transferring thruster operation reaction forces to the hull in all of those horizontal directions. Other structures (see FIG. 26) are relied upon to support the canister in its elevated position in the hull independently of the rack and pinion vertical drive mechanism described above.

When locking pins 78 and 79 are in use, it is desirable that they be secured in their extended positions by a mechanism which is different from the hydraulic mechanism provided to drive them between their extended and retracted positions. As shown in FIGS. 14–17, a retractable locking wedge 81 is cooperable with the end of the locking pin which lies within the canister shell. The locking wedge is moved between its engaged and disengaged positions relative to the adjacent locking pin by a pneumohydraulic ram assembly 82 located above the locking wedge and connected to it by piston rod 83 which is connected within the ram assembly to a piston 84. As shown best in FIG. 14, each locking wedge 81 is centrally recessed in a downwardly open manner so that, when viewed in the manner shown in FIG. 14, the locking wedge has a configuration which resembles a fork having two parallel vertical tines 86. In the engaged position of the locking wedge, shown in FIG. 14, the tines straddle a fixed, axially hollow piston rod 87 which is mounted to a fixed base assembly 88 shown in FIGS. 15, 16 and 17. A hydraulic fluid flow duct 89 extends from an inlet at the base assembly through the base and axially along piston rod 87 through a piston 90 carried at the opposite end of the piston rod. Duct 89 opens from piston 90 into a chamber 91 formed in one end of a cylinder 92. The opposite end of the cylinder is slidably sealed to piston rod 87 adjacent to base assembly 88. As will be seen from FIG. 17, a second chamber 93 is defined within cylinder 92 around piston rod 87 on that side of piston 90 which faces toward base assembly 88. A hydraulic fluid flow passage 94 is formed through the cylinder into communication with chamber 93.

Figure 17:
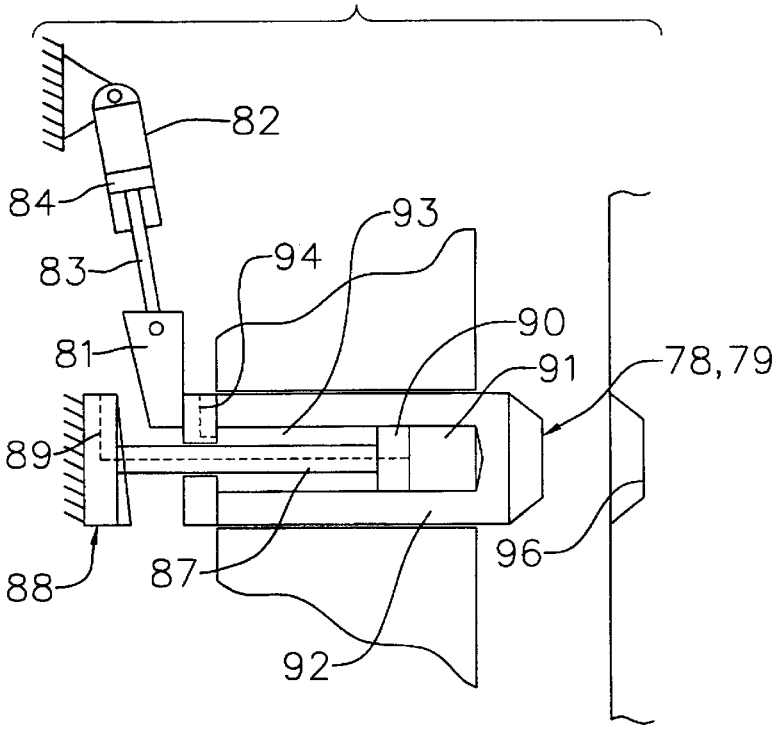
FIG. 17 is a schematic and fragmentary cross-sectional elevation view of the system for moving the canister locking pins and locking wedges.

The included angle between the opposing faces of base assembly 88 and the adjacent end of cylinder 92 corresponds to the included angle between the working faces of wedge 81. It is preferred that the face of cylinder 92 which faces the base assembly is perpendicular to the elongate extent of piston rod 87. Cylinder 92 and piston 90 are components of a hydraulic ram in which the piston is stationary and the cylinder is movable. It is the cylinder which forms locking pin 78 or 79. The end of the pin cylinder opposite from wedge 81 preferably is circumferentially chamfered, as shown in FIG. 17, so that when it is engaged in a correspondingly contoured socket recess 96 in the canister trunk wall, the cooperation of the pin with the socket recess establishes a predetermined positional relation between the thruster canister and the adjacent vessel hull structure.

A locking pin 78, 79, as defined by a cylinder 92, is driven into seating engagement with a hull socket recess 96 by applying hydraulic fluid at a desired pressure to chamber 91 through passage 89. That hydraulic pressure is maintained in chamber 91 while air pressure is applied to the upper end of ram 82 to drive wedge 81 into its engaged position between the opposing faces of cylinder 92 and base assembly 88 in the manner shown in FIG. 16. The effective taper of wedge 81 is selected so that the wedge cannot be driven from its engaged position by forceful movement of cylinder 92 toward the base assembly. After the wedge has been moved to its engaged position as described above, it is no longer necessary to maintain hydraulic pressure in chamber 91 or to continue to apply air pressure to the upper end of ram 82.

To unlock a thruster canister from its trunk, hydraulic pressure is applied to the lower face of piston 84 in ram 82 to move the corresponding locking wedge 81 to its disengaged position. In the disengaged position of the wedge, there is sufficient clearance between base assembly 88, cylinder 92 and the wedge to allow the corresponding locking pin cylinder to be moved toward the thruster canister by an amount sufficient to release the canister from locked relation to the trunk structure. Withdrawal of the pin from its socket recess 96 is accomplished by applying hydraulic pressure to chamber 93 within cylinder 92.

Locking pins 78 and 79 and their associated structures in the canister and the canister trunks must be sufficiently strong to hold the canister of a deployed thruster in forceful contact with the canister seat and seal arrangement described above and against both hydrostatic and hydrodynamic forces which may be applied to the canister after the annulus between the canister and its trunk has been pumped out following engagement of the canister with its seat structure. It is apparent, therefore, that the structures of the canister and the vessel hull, particularly around the perimeter of a thruster opening 25 through the hull, must be designed to support the dead weight of the thruster and the force, preferably about 40 tons, applied vertically to the canister to overcome the hydrostatic and hydrodynamic forces as described above. As noted above, the locking pins and the structures associated with them are relied upon to transmit thruster operation reaction forces to the hull, and so ruggedness of the pins and those structures is important.

Figure 18:
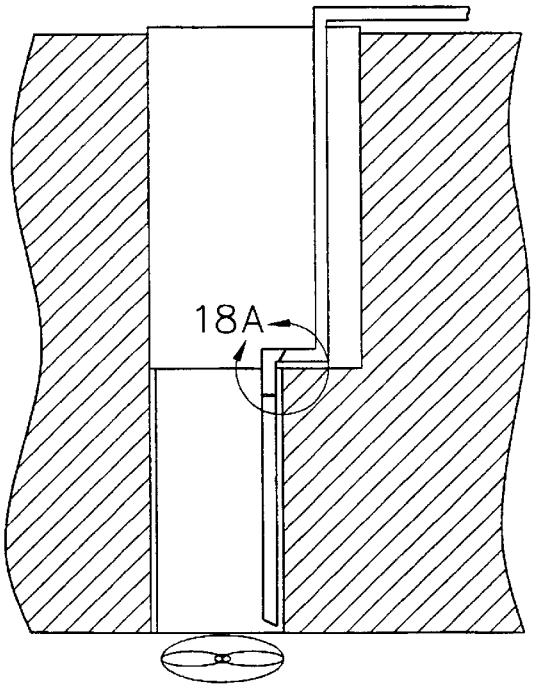
FIG. 18 is a simplified cross-sectional elevation view of a thruster in its deployed position with a detail in FIG. 18A of that view which shows the cooperation between a ventilation duct carried by the canister with a ventilation duct carried by the hull.
Figure 18A:
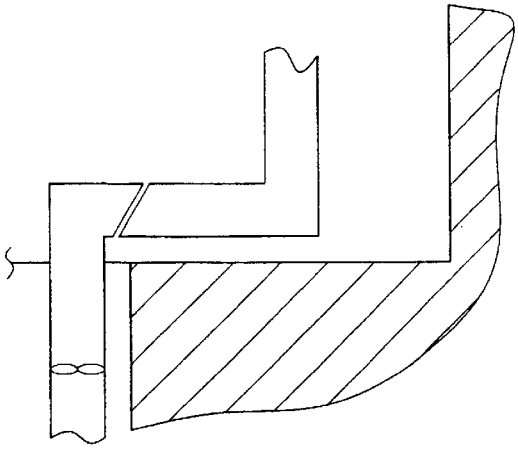
Figure 19:
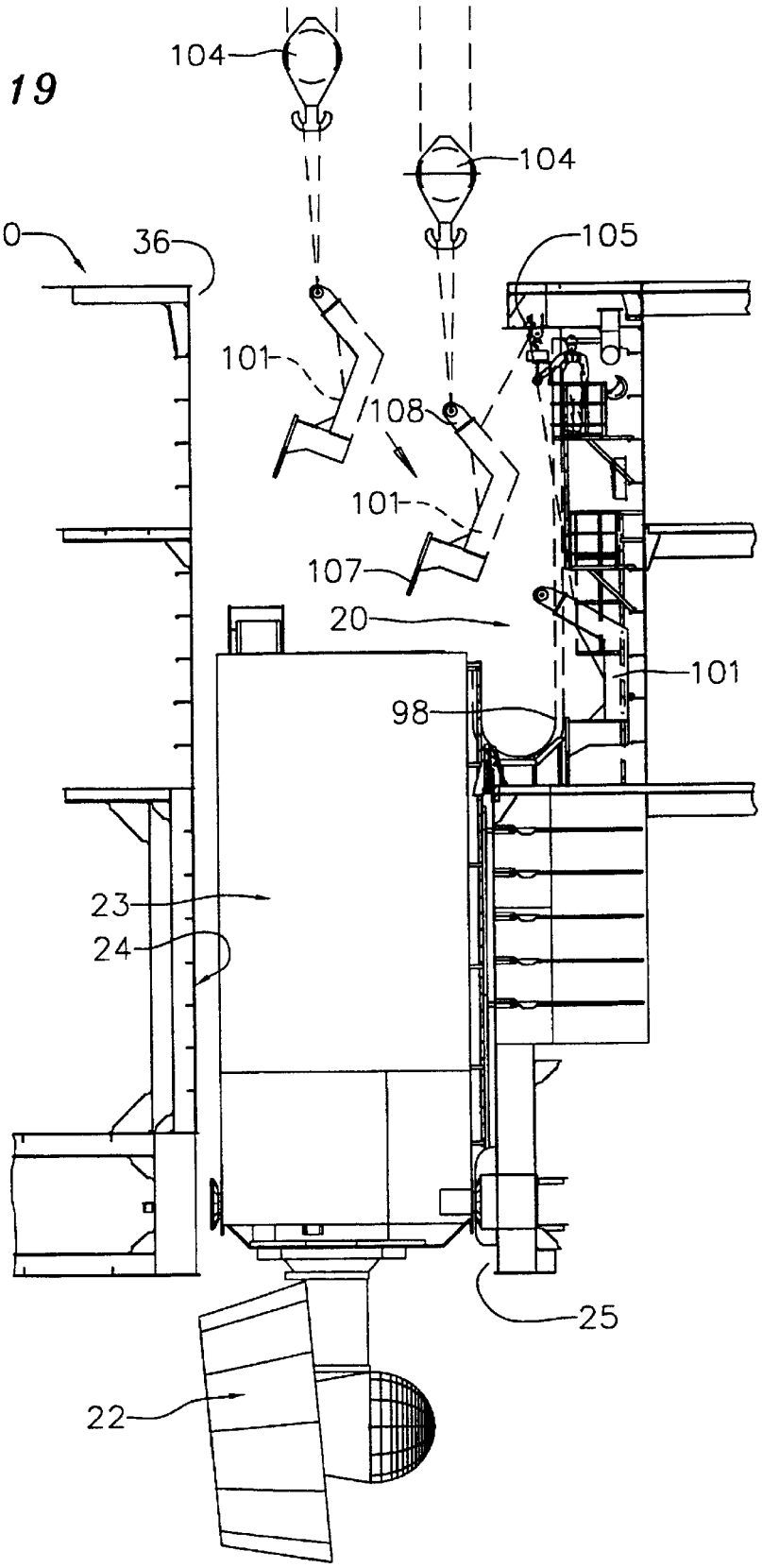
FIGS. 19–24 simplified cross-sectional elevation views showing structures and procedures for moving a thruster as shown in preceding Figures from its deployed to its service position and for handling the propeller at the service position.

It is very desirable that a thruster canister be ventilated in each of its three intended stable positions vertically within hull 11. The deployed position of the canister is most critical because it is in that condition that thruster motor 49 is operated and heat is generated within the canister. FIGS. 18 and 18*a* illustrate in a simplified way how an exhaust duct carried by a deployed thruster canister can cooperate with an exhaust duct fixed in the canister trunk and yet still permit vertical movement of the canister in its trunk to its retracted and elevated positions.

A flexible multi-function electrical and fluid umbilical assembly is connected between each thruster canister and the adjacent vessel structure. The umbilical assembly is capable of following vertical movement of the thruster canister through its range of movement vertically in the vessel while supplying all necessary electrical and fluid connections to the canister. The umbilical assembly for each canister is represented schematically at 98 in FIG. 2. More specifically, each umbilical assembly contains electrical cables for supplying power to the thruster motor 49, electrical cables for supplying service power for illumination, ventilation, miscellaneous motor operation and the like to equipment within the canister. Still further electrical connections are provided for supplying control signals to the canister for regulating operation of the thruster drive motor 49 and its azimuthing (steering) drive mechanisms. In addition, each umbilical assembly includes separate hydraulic and pneumatic hoses for supplying hydraulic and pneumatic power to mechanisms within the thruster canister. Telephone and other communications connections can be included in each umbilical assembly. A hose is provided for conducting canister bilge pump discharge from the canister to the vessel.

The rack and pinion vertical drive mechanism coupled between each thruster canister and the adjacent hull structure is operable for moving a thruster quickly, smoothly and efficiently from its lowermost deployed position in the vessel to its elevated repair and maintenance position shown in FIG. 4. Because the rack and pinion drive can move the thruster smoothly and continuously to any desired vertical position within the hull, that form of thruster vertical drive mechanism is presently preferred in the practice of this invention. Other kinds of thruster vertical drive mechanisms can be used if desired. A hydraulically powered thruster vertical drive system 200 is illustrated in FIGS. 27–41, described more fully below.

Figure 25:
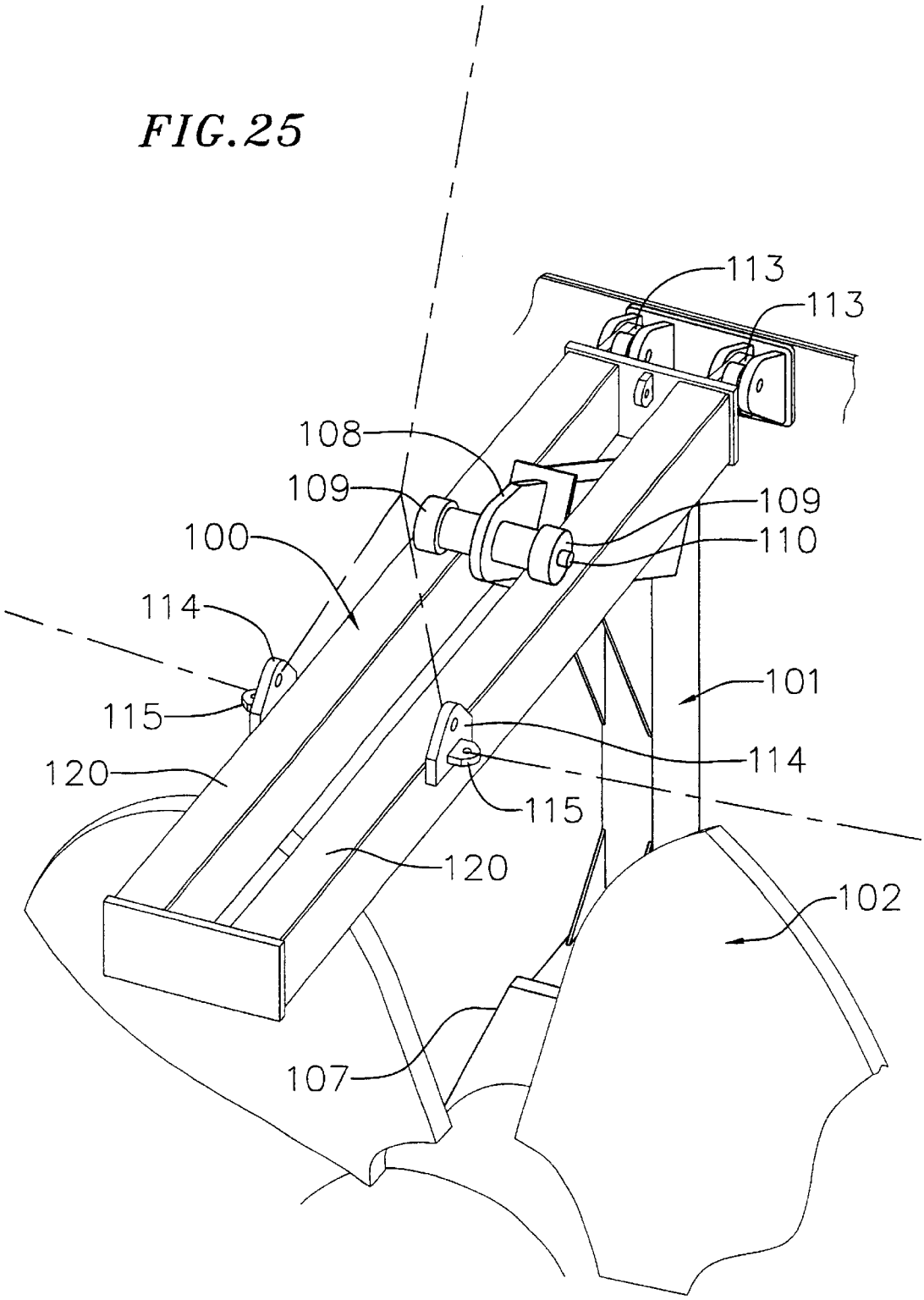
FIG. 25 is fragmentary perspective view showing a movable propeller handling track and a cooperating propeller removal tool in use at the stage of operation shown, e.g., in FIG. 24.

FIGS. 19–24 illustrate a series of steps in a method for accessing and servicing the propellers shaft seals and other elements within a thruster head assembly 22 on board vessel 10 as may be required from time to time. FIG. 25 shows a working relation between a movable track beam 100 and a propeller removal and handling tool 101 which is useful to support the propeller 102 of the thruster as it is removed from the thruster head assembly, stored in service space 20, and reconnected to its mounting shaft in the thruster.

A thruster typically is found to require service at a time when the thruster is deployed. In that event, operation of the thruster is terminated and the thruster is kept in its deployed position. The access hatch 36 at the upper end of the thruster trunk is opened or removed. The propeller removal and handling tool 101 is lowered into a stored location in service space 20, preferably by use of a hook on a traveling block 104 of a shipboard crane (not shown) and by use of a chain block 105 provided in the upper part of the service space. Tool 101 can be generally "C" shaped when viewed from the side. At its lower end it carries a mating plate 107 by which the tool is boltable to the face of the hub of propeller 102 which is exposed toward the service space 20 when a closure plate on the propeller hub is removed. At its upper end, tool 101 has a projecting lug 108 through which there is a hole by which coaxial rollers 109 can be connected to the tool, on opposite sides of the lug, by an axle 110 carried in that hole; see FIG. 25. As first introduced into service space 20 through hatch 36, the tool preferably does not have rollers 109 coupled to it.

Figure 20:
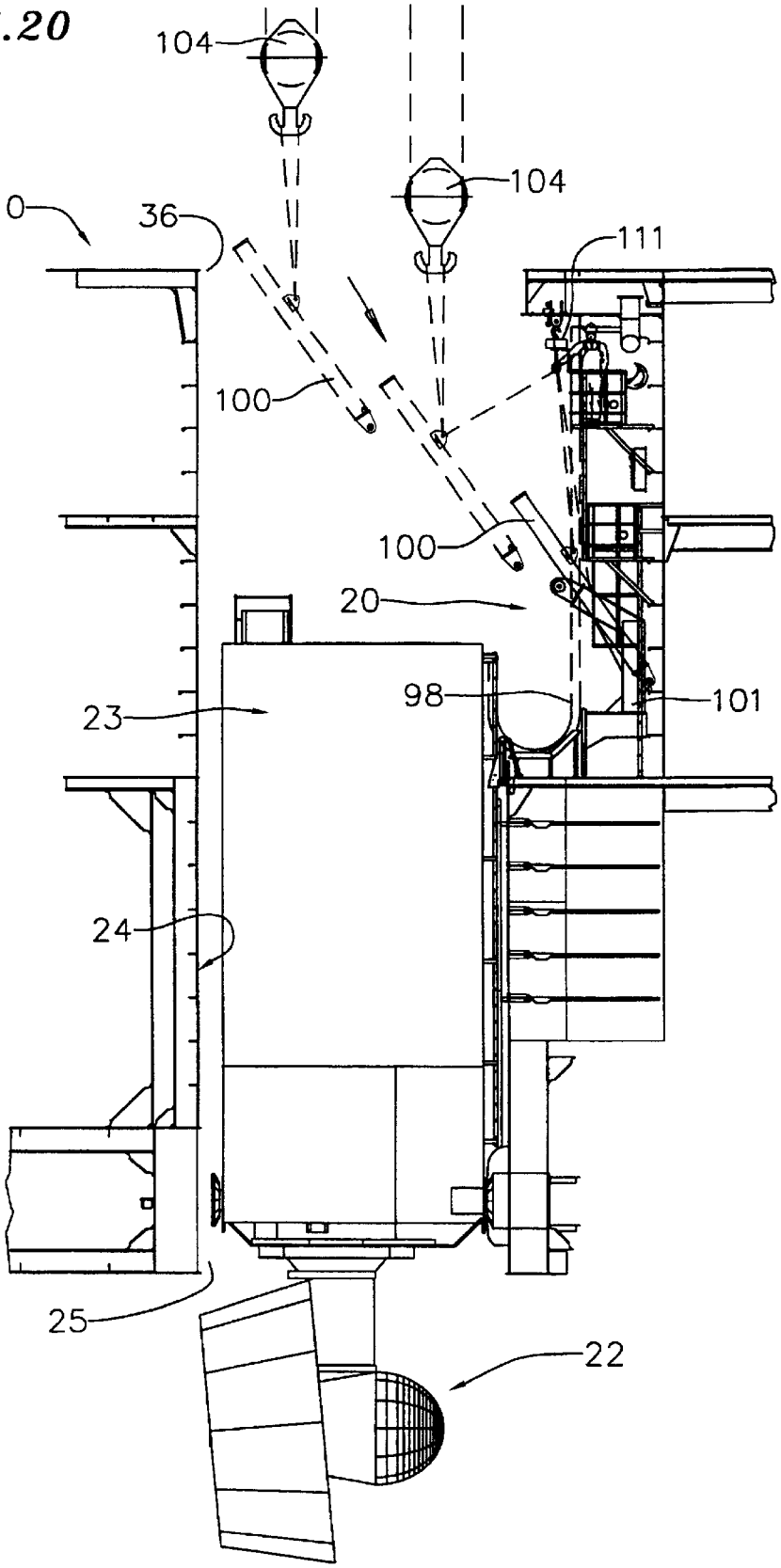

Also, as shown in FIG. 20, while the thruster is in its lowermost deployed position, the movable track beam 100 is lowered into space 20 through the open hatch and is stowed temporarily in the service space. Movement of the track beam to its desired storage location can be assisted by use of an air hoist 111 provided in the upper portion of the truster service space near chain block 105. As shown in FIG. 25, beam 100 preferably includes at one end a pair of apertured lugs 113 via which that end of the beam can be pinned to cooperating brackets affixed to the wall of space 20 at a desired location in the space. At a location between the midlength of the beam and its other end, the sides of the beam carry vertical 114 and lateral 115 apertured lugs which are useful for rigging the beam as it is introduced into space 20 and for other purposes described below.

The thruster to be serviced then is raised in its trunk to its service position after the thruster head has been turned so that the thruster propeller is adjacent to the thruster trunk wall which opens to (terminates at) the floor of the trunk service space. It is noted above that it is preferred not to rely on the rack and pinion thruster vertical drive system to hold the thruster at any position in vessel hull 11 for any extended time. When the thruster is at its service position, other mechanisms than the locking pins cooperate between the thruster trunk and the thruster canister to support the thruster canister. One of those other mechanisms is shown in FIG. 26.

Figure 26:
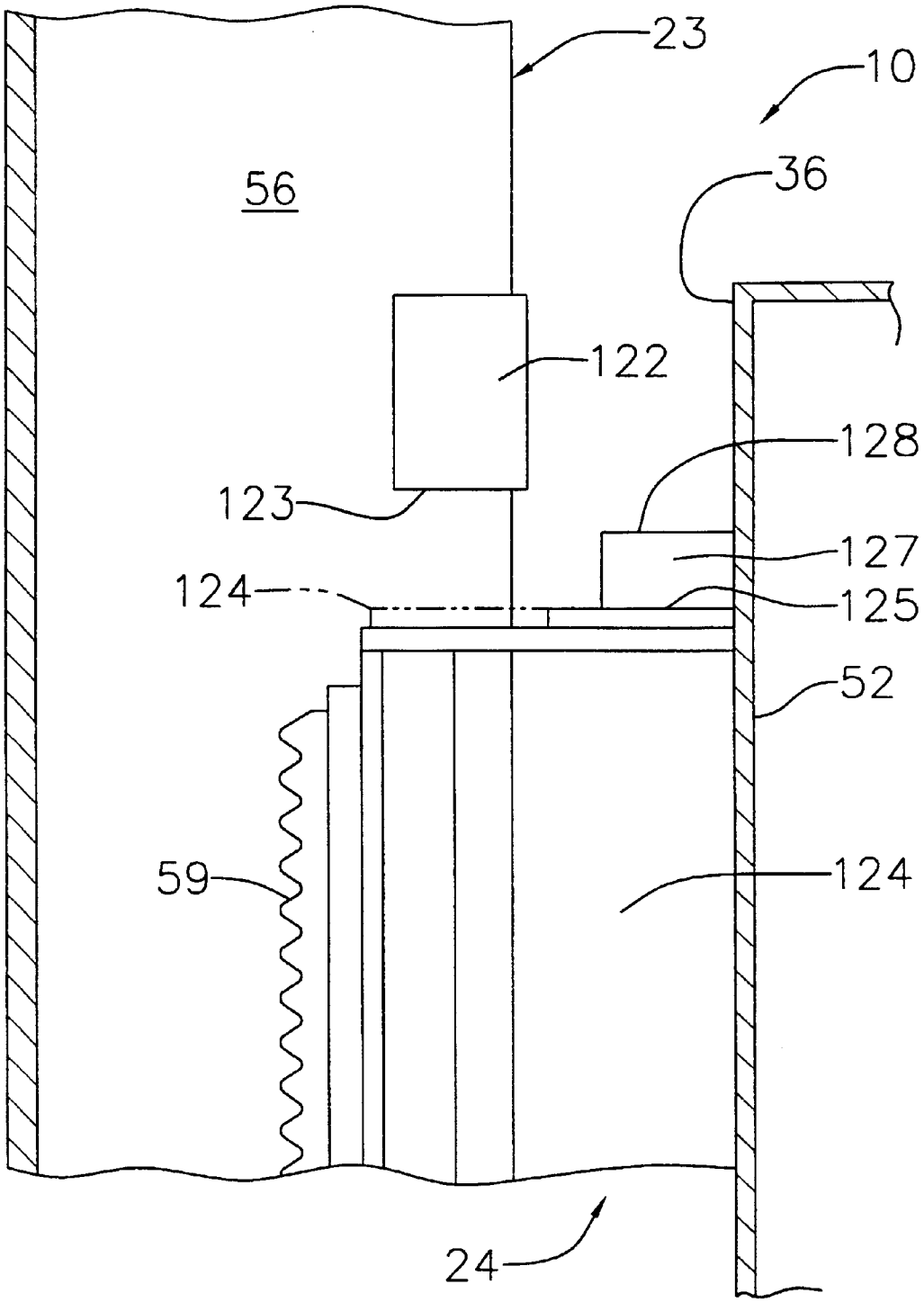
FIG. 26 is a view showing arrangements for holding the thruster in its trunk in the service position of the thruster.
Figure 27:
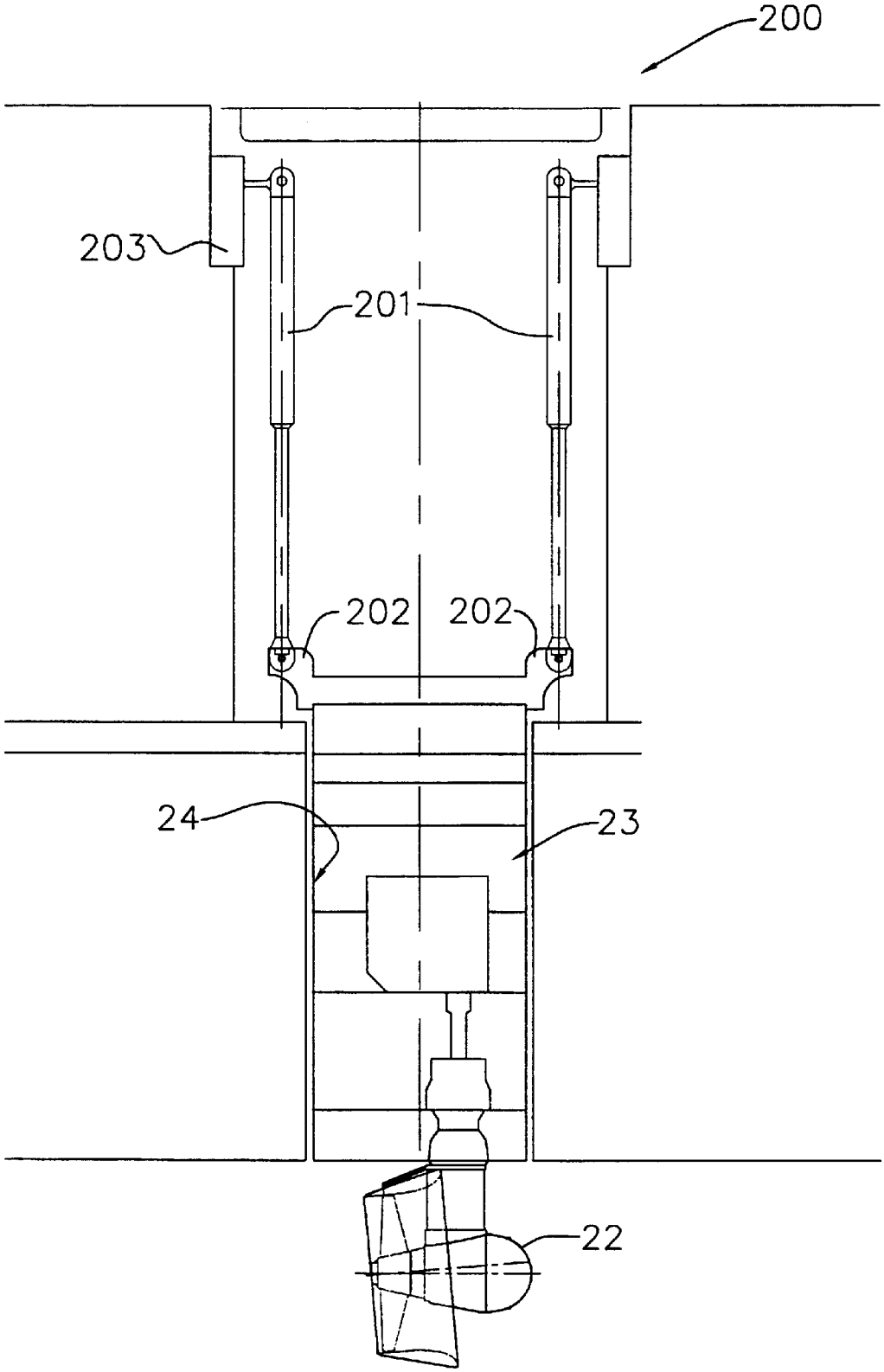
FIGS. 27–41 are simplified cross-sectional elevation views showing structures and procedures for moving the thruster between its deployed, its repair and maintenance, and other positions according to a second embodiment of the invention.
Figure 28:
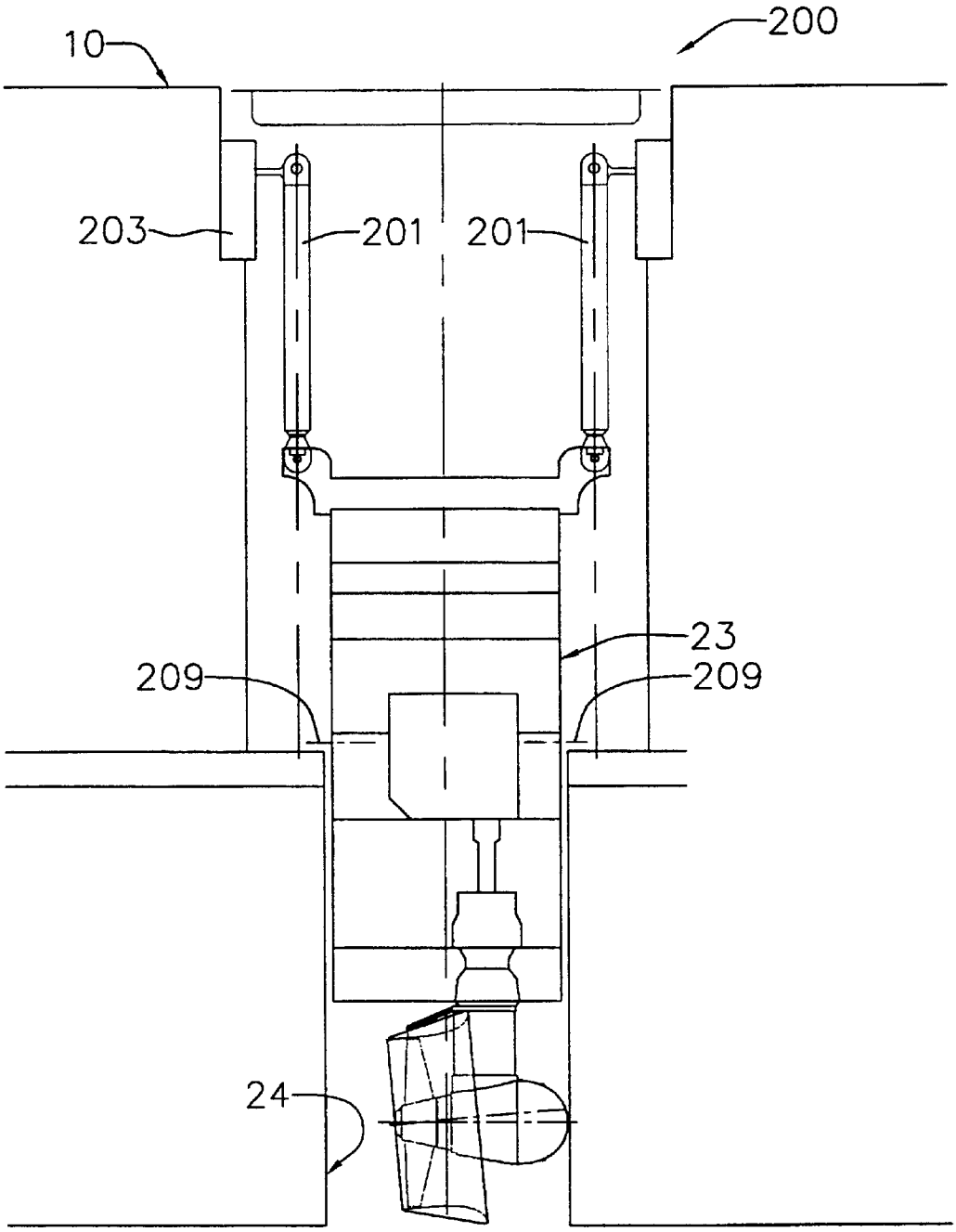

In FIG. 26, canister 23 is shown at an interim position which is a short distance above its service position in trunk 24. The opposing walls of each canister rack recess 56 (only one of which is shown in FIG. 26) carry heavy blocking pads 122 where they intersect the outer walls of the canister; the lower edge of each blocking pad forms a downwardly facing horizontal ledge surface 123. In the interim position of the canister, surfaces 123 are above the upper end of the vertical foundation 124 which mounts the adjacent rack 59 to the corresponding trunk wall 52. A thick slide plate 125 is movably carried atop the rack foundation and has a width, in a direction parallel to trunk wall 52, which is slightly less than the width of the adjacent canister recess 56 between the surfaces to which the blocking pads 122 are mounted. However, the width of the slide plate is greater than the distance between the opposing surfaces of the blocking pads. The slide plate has a retracted position relative to the canister, shown in solid lines in FIG. 26, in which it is sufficiently away from the canister toward trunk wall 52 that it clears the outer extent of the blocking pads, thus enabling the canister to be raised to its interim position placing the blocking pads above the slide plates. As shown in broken lines in FIG. 26, each slide plate has an extended position toward the canister recess atop the rack foundation in which it is in line with (i.e., vertically below) blocking pads 122. Once the slide plates for the canister have been moved to their extended positions, the canister is lowered to its service position in which the blocking pad ledge surfaces contact the upper end margins of the slide plates. The slide plates then support the canister via the blocking pads.

Slide plates 125 can be located, in their retracted positions, in a downwardly extending, upwardly opening notch 127 in a hatch support frame 128 which extends circumferentially of the trunk below hatch opening 36, as shown in FIG. 26. If desired, however, the slide plates can be mounted below a continuous hatch support frame.

Figure 21:
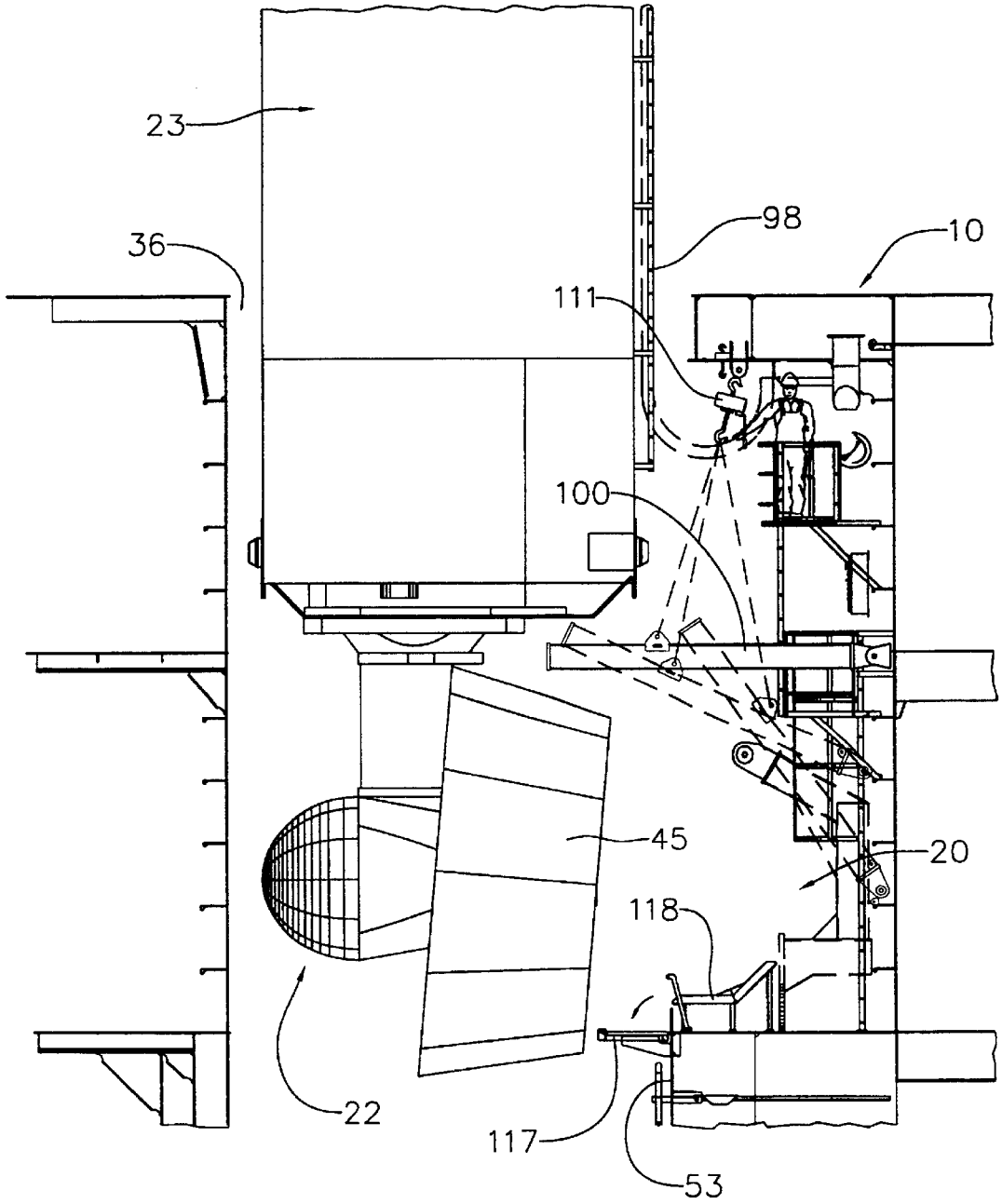
Figure 22:
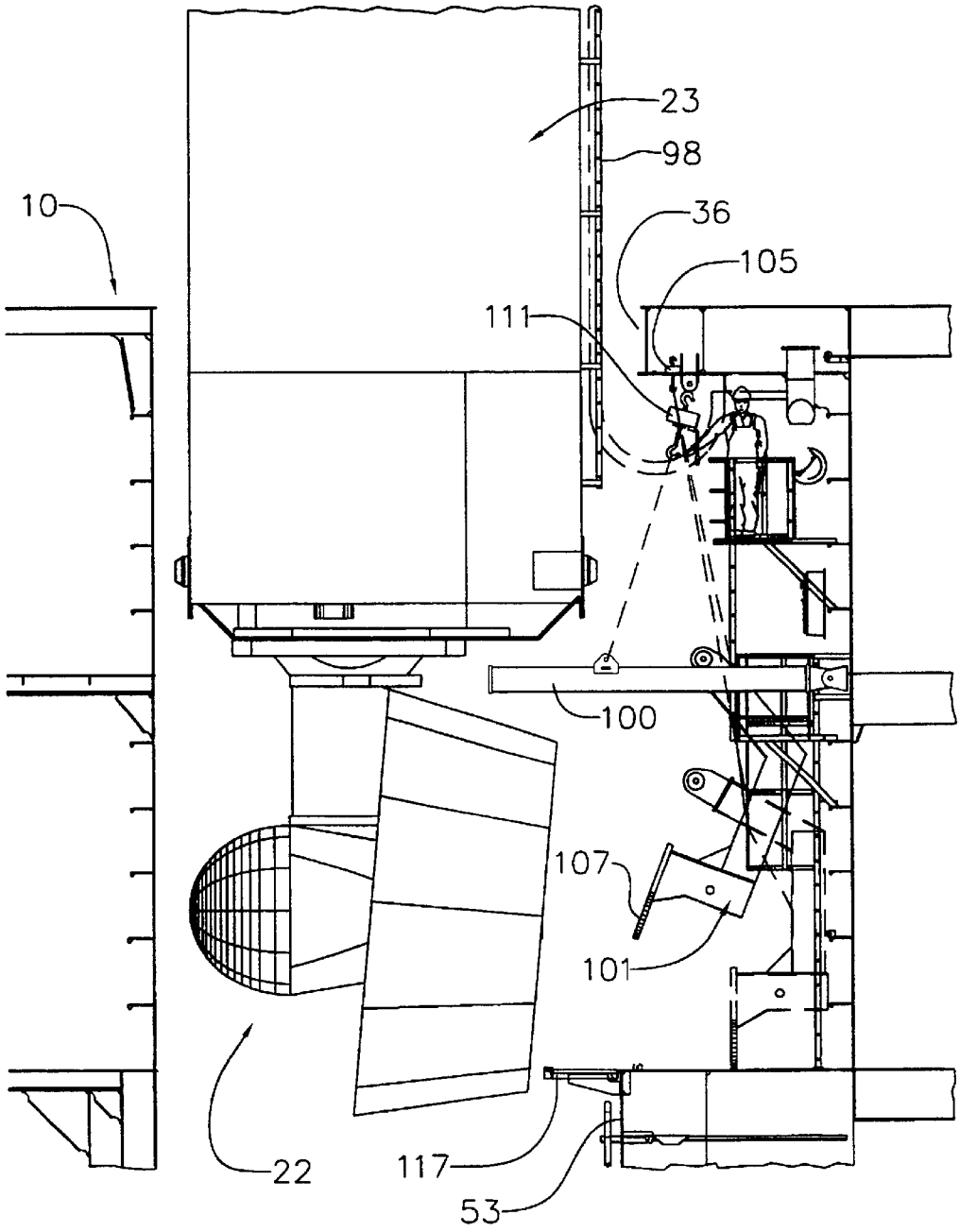
Figure 23:
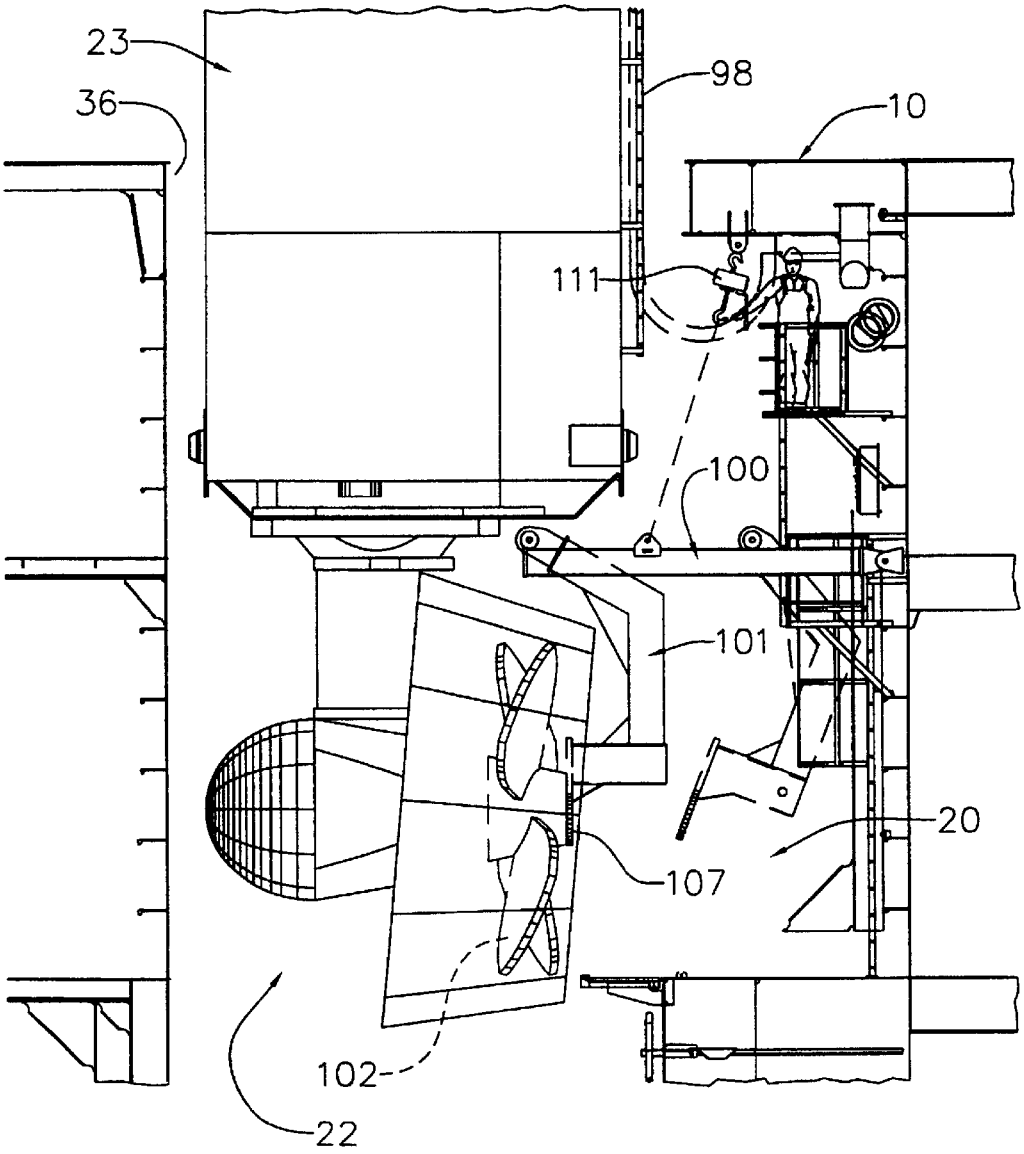
Figure 24:
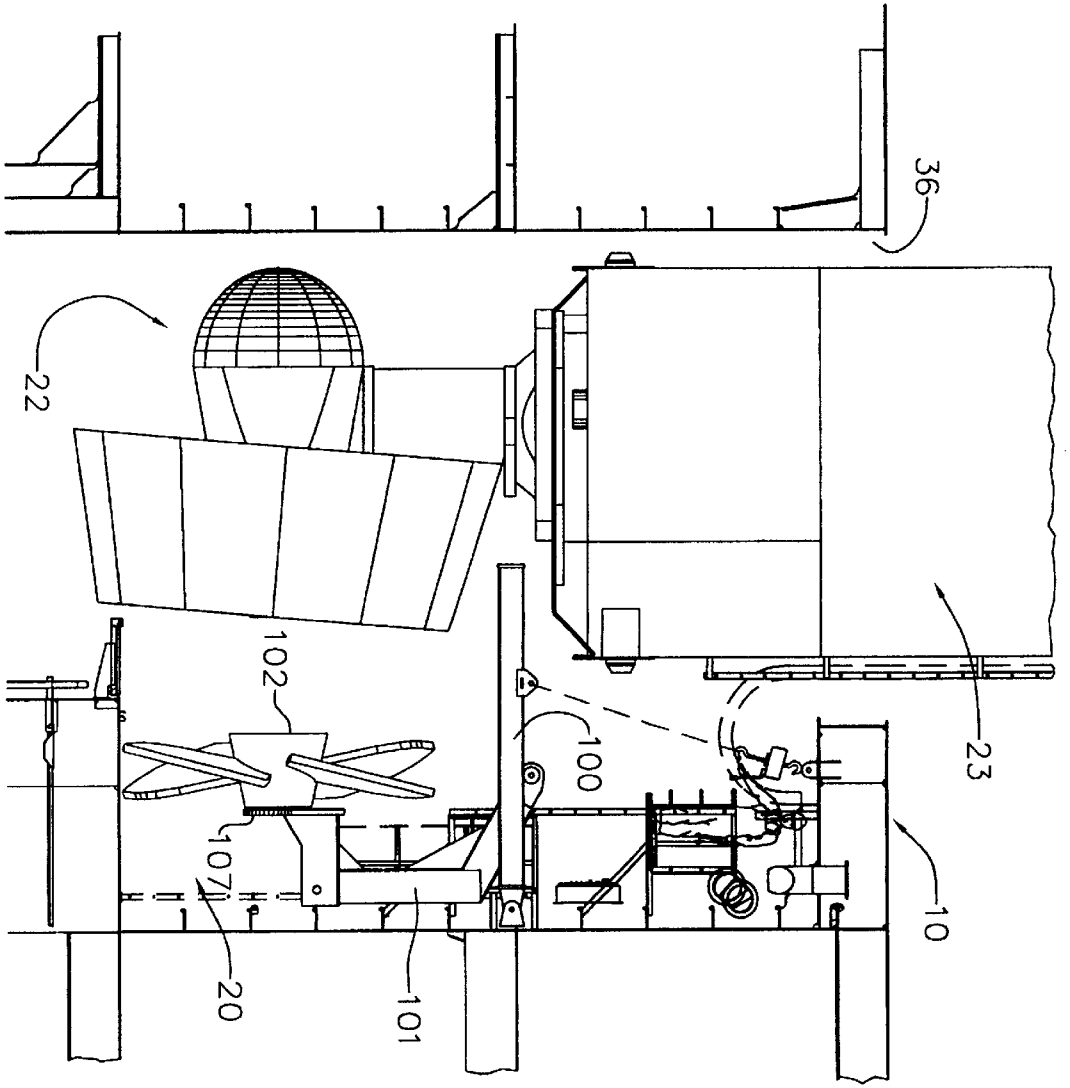

When the thruster is at its service position, its propeller is facing toward the service space. That is shown in FIG. 21. Movable work deck sections 117, hinged to trunk wall 53 at its upper extent, can be released from holders which have held them in vertical position and then swung to their horizontal usage positions in which they extend into trunk 23 adjacent to the lower end of the thruster head 22. See FIG. 21. The holder for the movable deck sections, and also cradles 118 for supporting umbilicals 98 for the thruster when deployed (see FIG. 20) can be removed from the floor of the service space, as shown in FIG. 22. The movable work deck sections 117 may be supplemented by portable deck sections to provide decking in the thruster trunk across the top of trunk wall 53 and, if desired, around the comers of the trunk.

As also shown in FIG. 21, movable track beam 100 can then be moved into its usage position by the aid of air hoist 111, pinned to the wall of space 20, and supported horizontally in the service space by cables connected from the air hoist to the beam's vertical lugs 114. The track beam can be stayed laterally by cables connected to the beam's lateral lugs 115 and to suitable anchors on the trunk side walls. When properly positioned and supported in the service space, the track beam lies in a vertical plane which also includes the shaft which carries thruster propeller 102. The beam extends into the space present between the top of the thruster nozzle shroud 45 and the bottom end of canister 23.

FIG. 25 shows that track beam 100 is composed of a pair of spaced and parallel structural elements which extend from end to end of the beam and which have flat top surfaces. Those two elements function in the beam as a pair of rails 120. After the beam has been rigged into its usage position as described above, propeller removal and handling tool 101 is coupled to the beam. The tool is coupled to the beam by raising the tool from its stowed position in space 20, as by use of chain block 105, so that the lug 108 at the upper end of the tool projects between and above rails 120. Rollers 109 and axle 110 are then connected to that lug so that the tool can be movably supported by the track beam and can be moved along it as desired.

The closure plate at the end of the hub of propeller 102 which faces service space 20 is removed. The angular position of the propeller in the thruster head is adjusted, if needed, so that bolt holes in the end face of the propeller hub can register with bolt holes in the mating plate 107 of tool 101. The tool and the propeller are bolted together. The center of mass of the coupled propeller and tool then is essentially directly below tool rollers 109. As a result, the propeller can be disconnected readily from its supporting shaft in the thruster head and moved away from the thruster head into space 20 by moving the tool along the track beam. The thruster head now is accessible for service of its bearings, seals and other components as appropriate. Any other components of the thruster which require attention or repair can be addressed at the same time.

The thruster can be returned to its operational deployed position in the vessel by reversing the sequence of events described above and shown in FIGS. 19–26.

System 200 includes a pair of long stroke, double-acting hydraulic rams 201 which are vertically disposed in the trunk and which are connected at their lower ends to lifting lugs 202 securely connected to the sipper end of thruster canister 23 at diametrically opposed locations on the canister. The upper ends of rams 201 are releasably yet securely connectible to foundations 203 carried in the upper ends of the canister trunk. As so connected between the canister and the vessel the travel of rams 201 is adequate to enable the thruster to be moved from its deployed position (FIG. 27) to its retracted position (FIG. 28) within the hull. To enable the thruster to be moved in the hull from its retracted to a further elevated position which may, in this instance, be on the deck of the vessel (see FIG. 41), a hatch closing the upper end of the thruster trunk is removed and a portable auxiliary hoisting frame 205 is engaged at its lower end in suitable seats defined in the upper end of the thruster trunk, see FIG. 29. When in place in a thruster trunk, the auxiliary hoisting frame has its upper end disposed substantially above the main or other weather deck of the vessel. The hoisting frame is composed of vertical structural members 206 located on opposite sides of the canister's path of vertical movement. Members 206 are connected at their upper ends to a cross frame 207 which may, if desired, also include a horizontally movable traveling crane. At selected locations along their vertical extents, vertical members 206 define connection points 208 to which the upper ends of rams 201 can be releasably yet securely connected. Use of the hydraulic vertical drive system 200 requires that there be multiple vertically spaced locking arrangements cooperable between the thruster canister and the hull structure at and above the retracted position of the canister; see FIG. 29.

Figure 29:
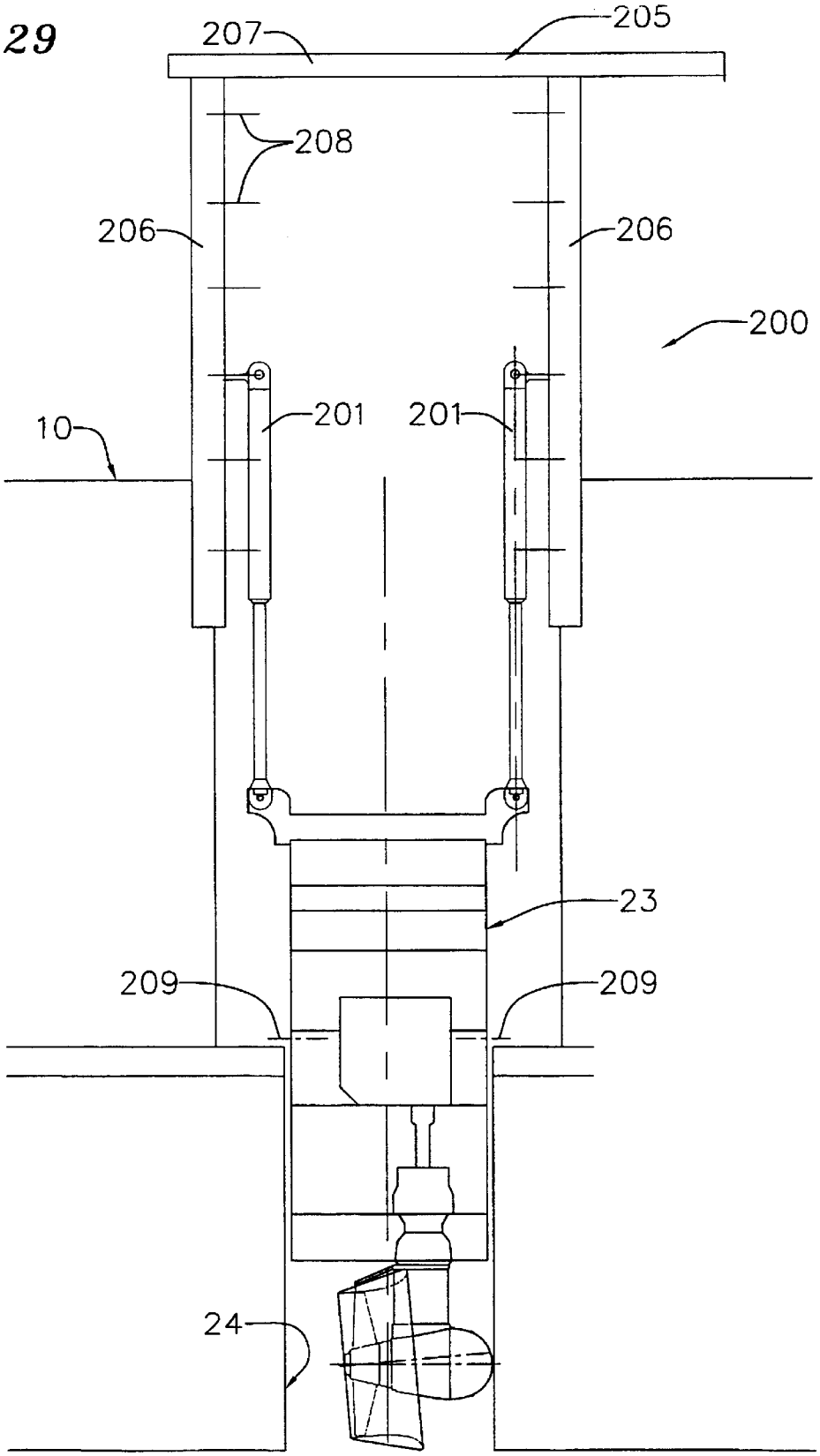
Figure 30:
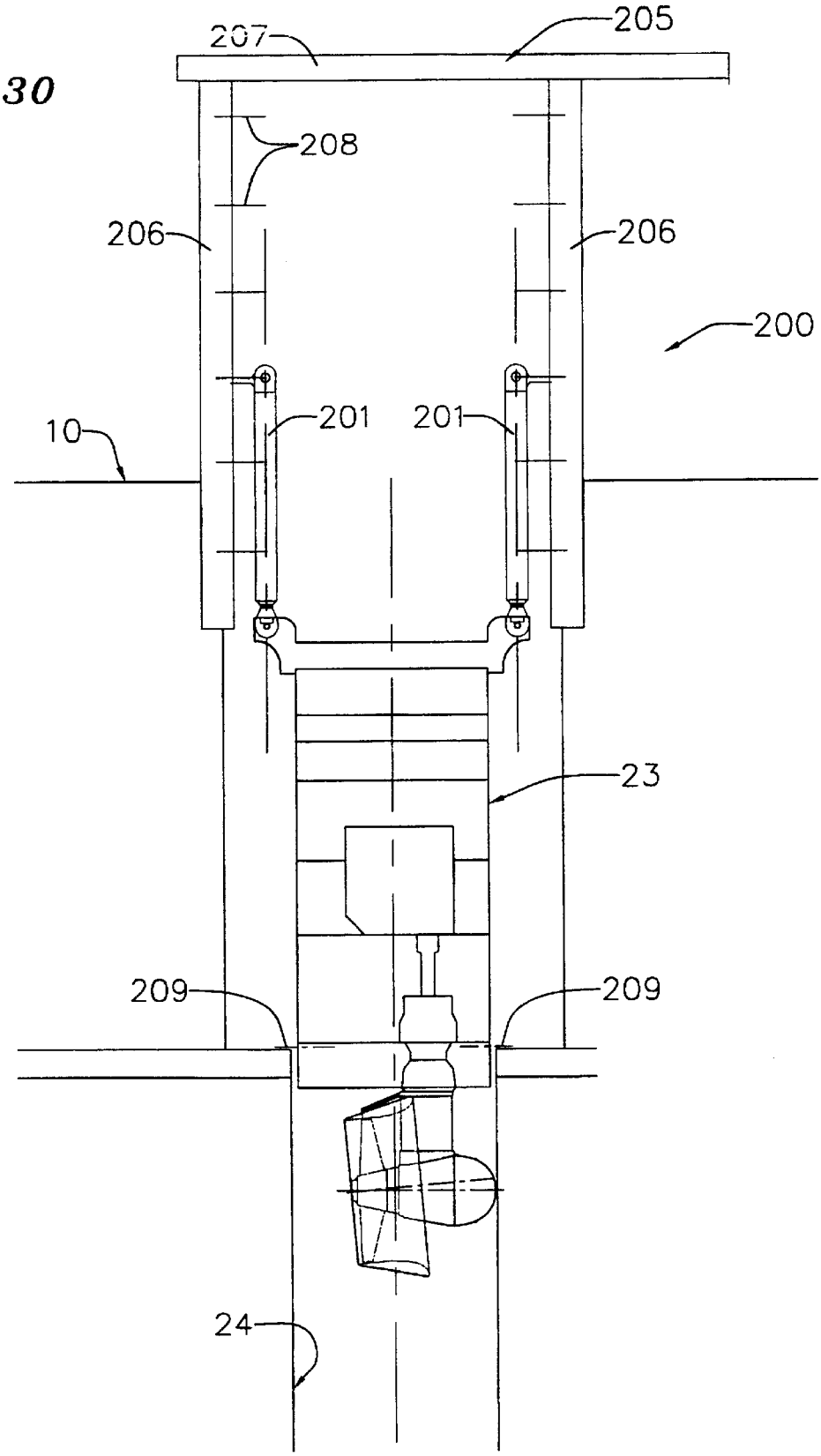
Figure 31:
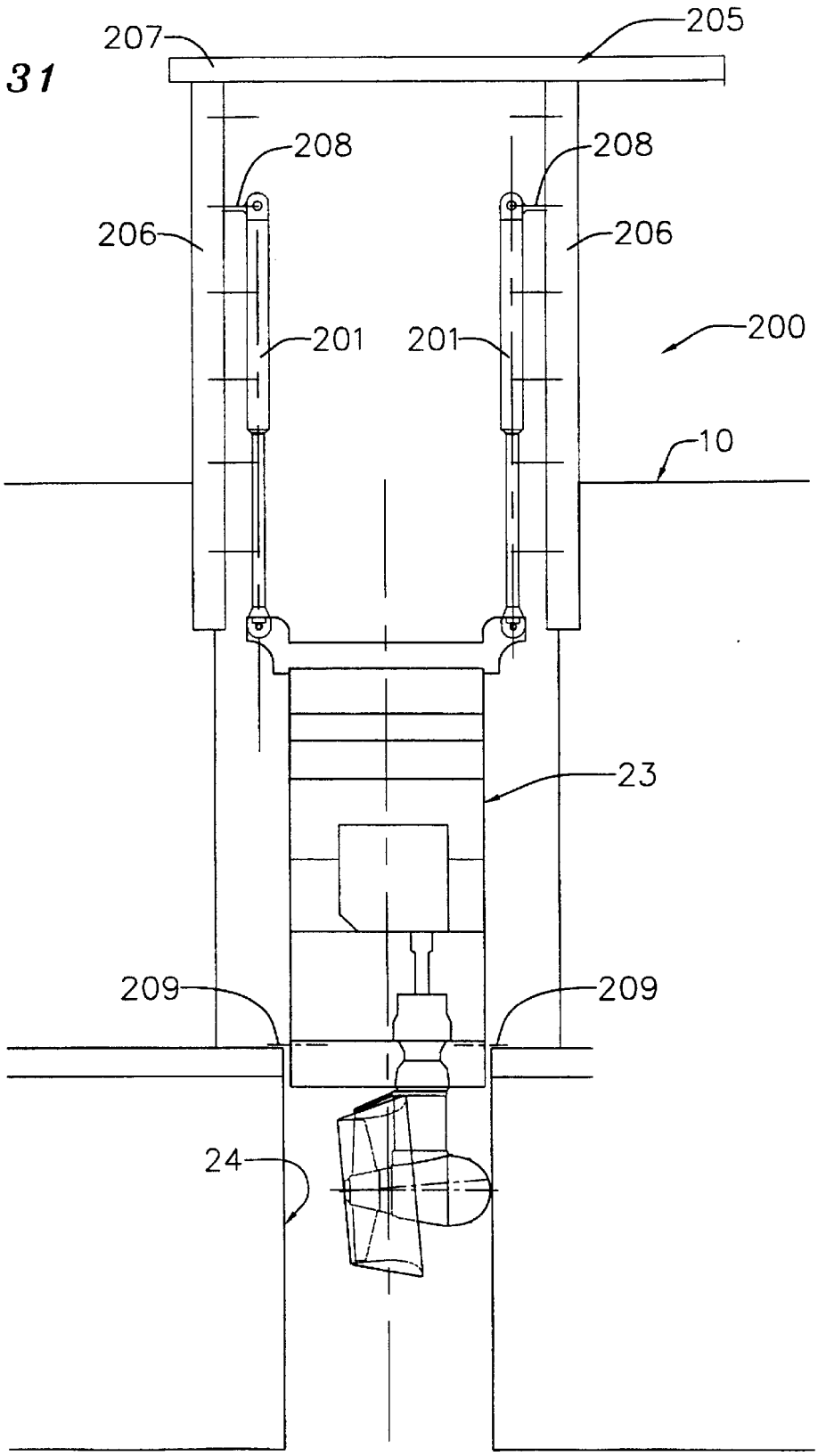

FIGS. 29, 30 and 31, for example, illustrate a sequence of operations using rams 201 and the auxiliary lifting frame 205 to move the thruster in a step-by-step manner upwardly in the vessel from the retracted position of the thruster. The canister is locked in its retracted position in the thruster trunk. The auxiliary lifting frame is put in place over the canister. Rams 201 are fully extended and connected at their upper ends to available connection points 208 in the hoisting frame. Rams 201 are then operated to raise the canister as far as possible in the hull for that state of connection of the rams to frame 205 and the thruster canister is then releasably locked to the hull structure as shown, e.g., in FIG. 30 at 109. The upper ends of rams 201 are then disconnected from their original connection points to frame 205, fully extended, and reconnected to the frame, see FIG. 31.

Figure 32:
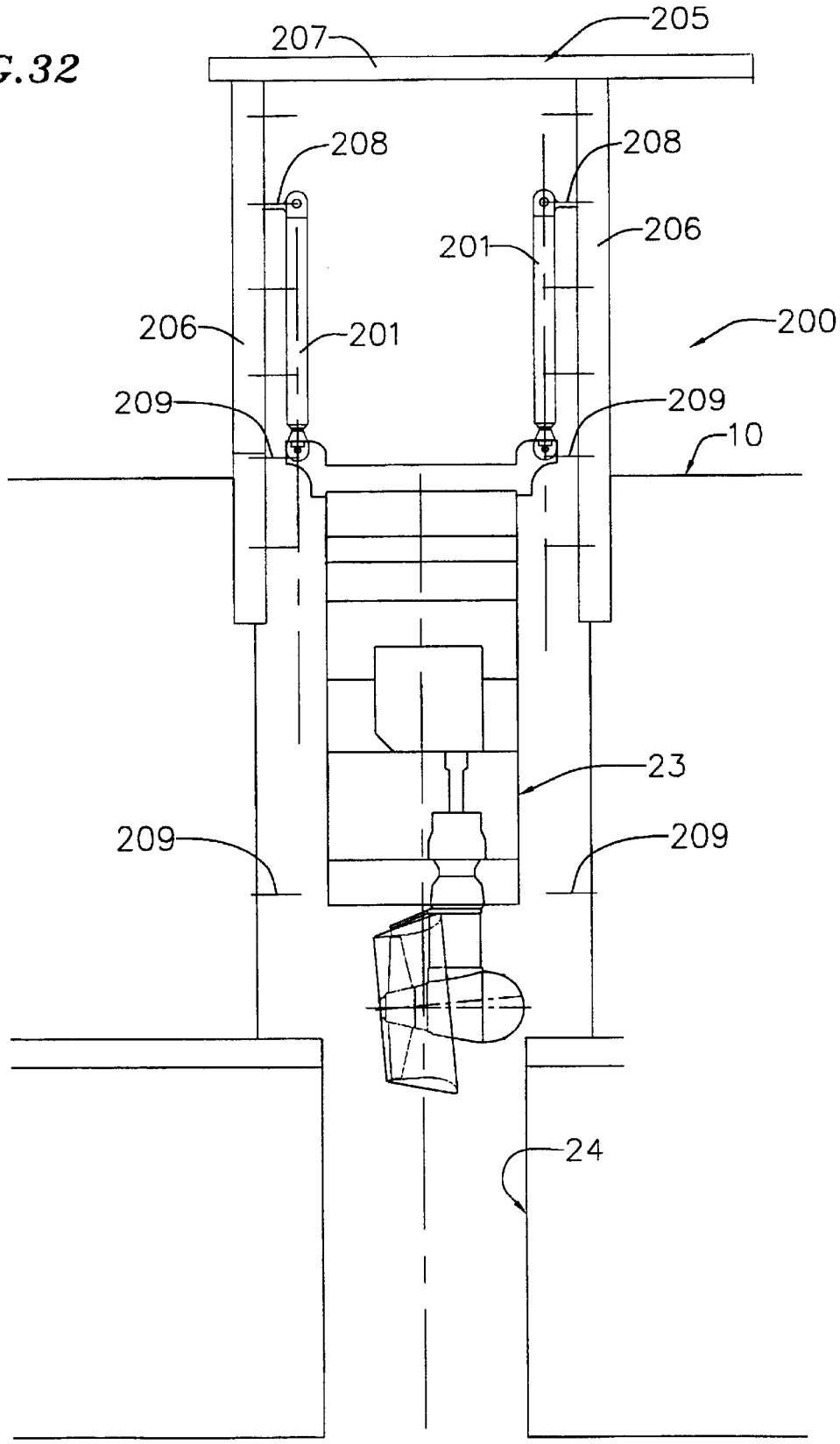
Figure 33:
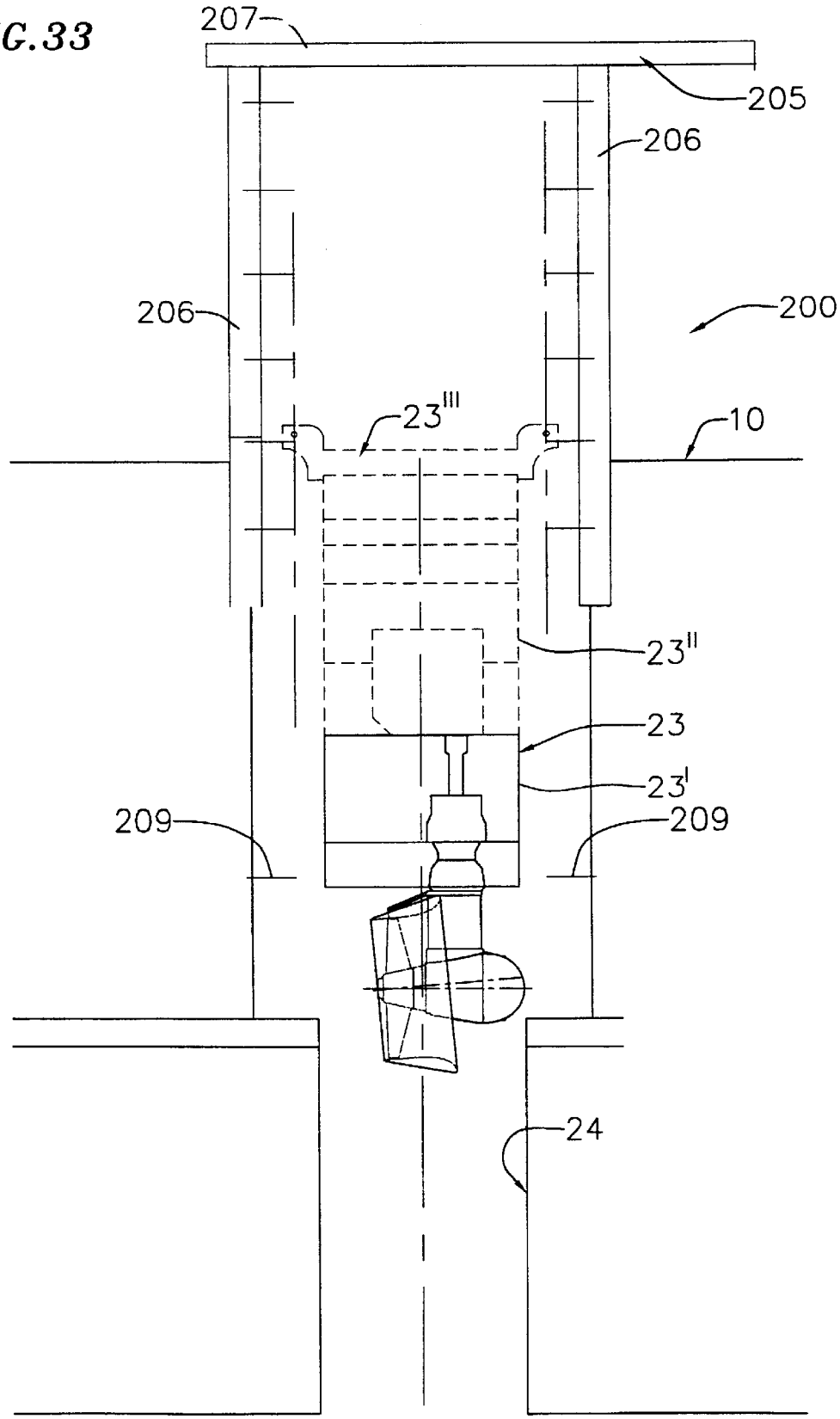

The sequence of operations as shown in FIGS. 29–31 and described above can be repeated using higher connection points of rams 201 to the frame, and high canister locking points 109, to raise the canister in its trunk to a position in which the thruster head is essentially dry in the trunk (see FIG. 32). In that position, repair or maintenance activities on the thruster and its various components can be performed.

Figure 34:
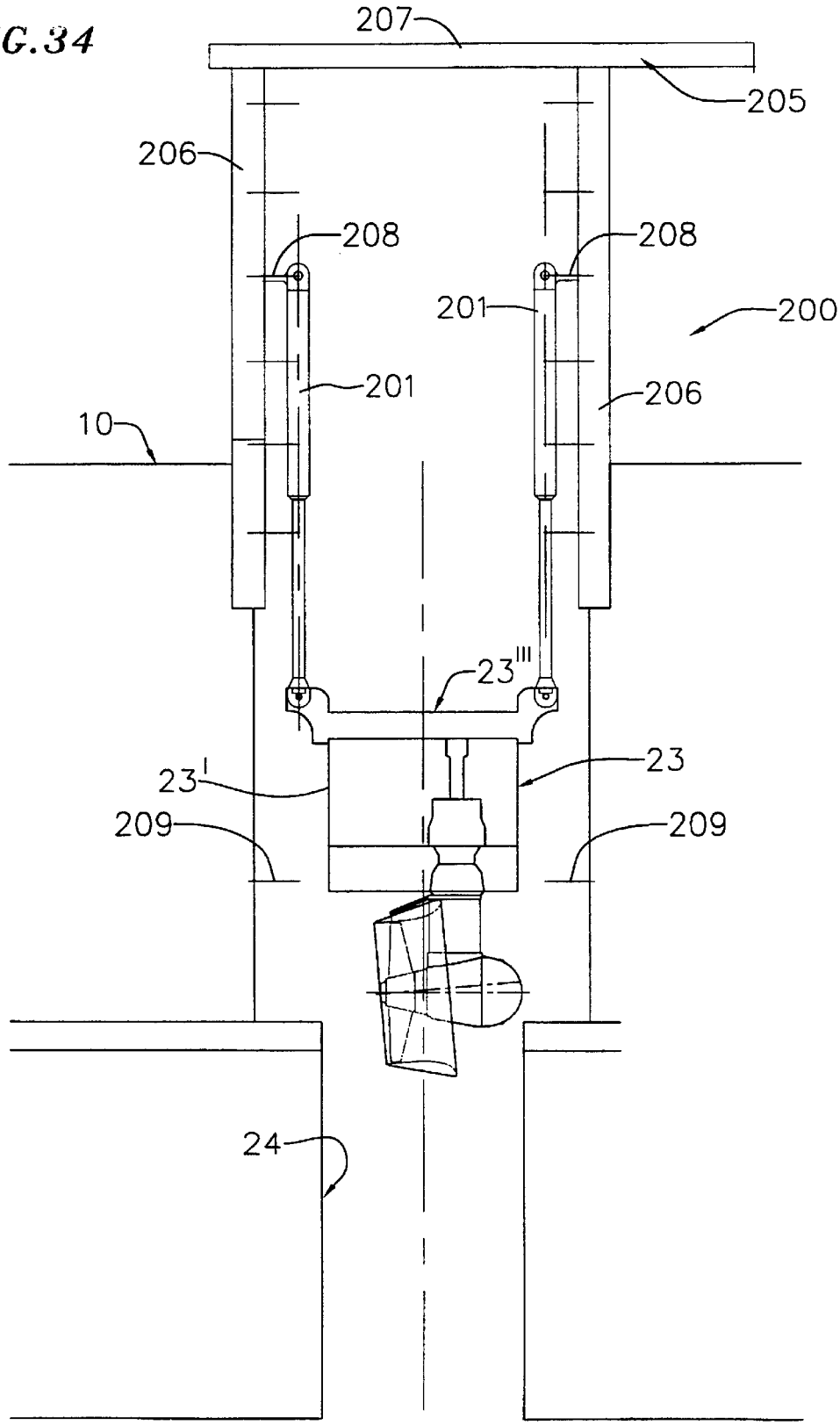
Figure 35:
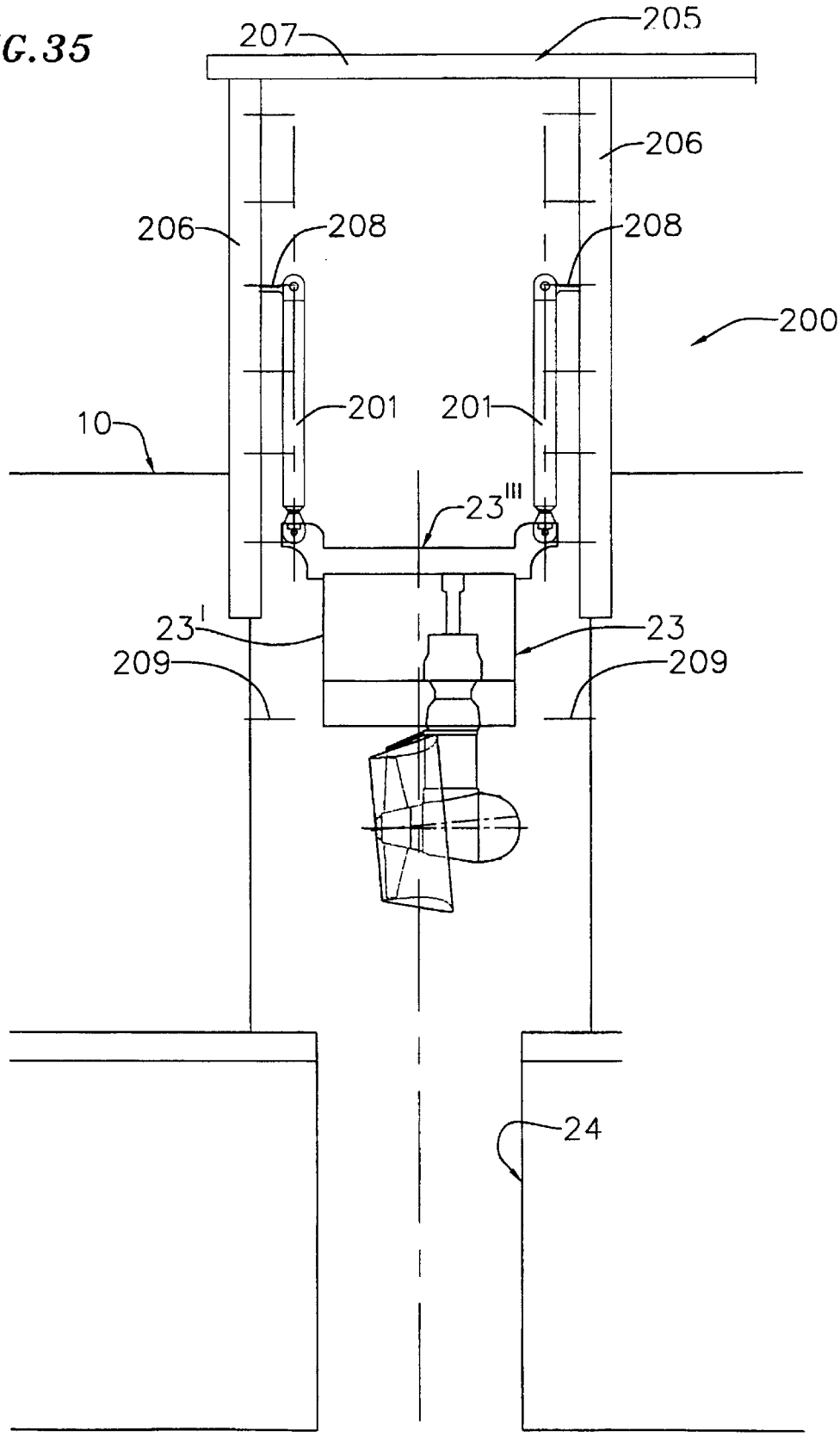
Figure 36:
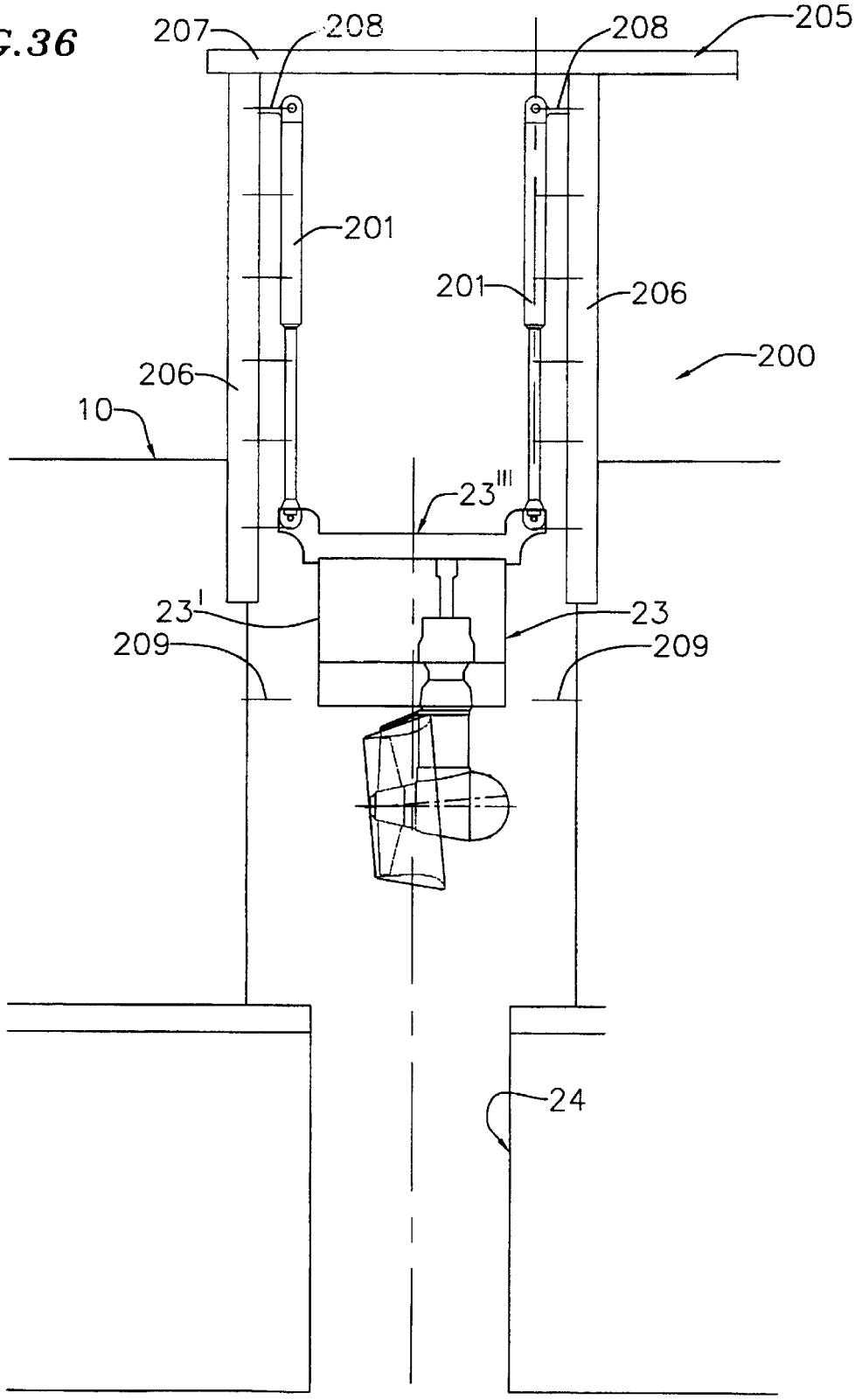
Figure 37:
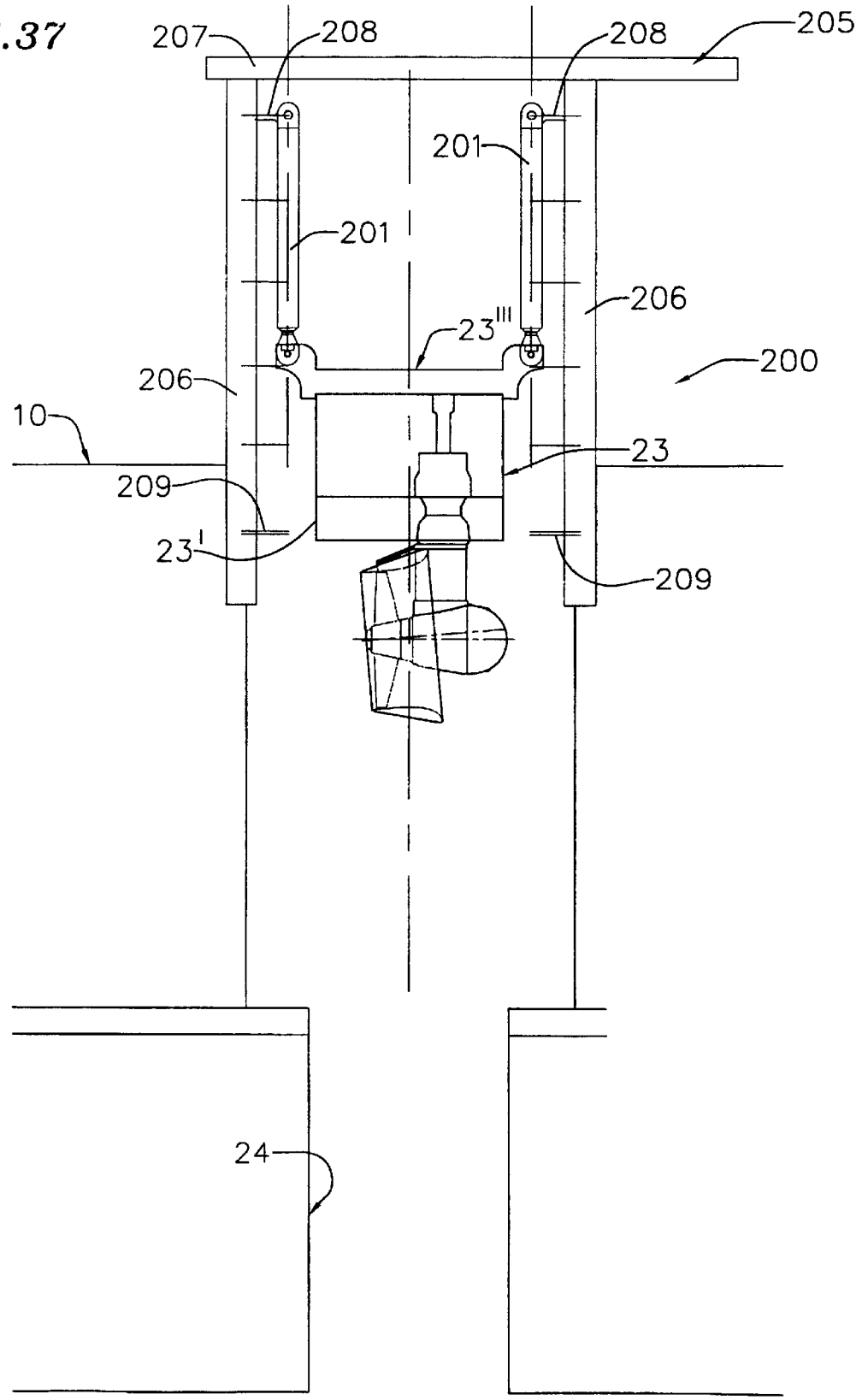
Figure 38:
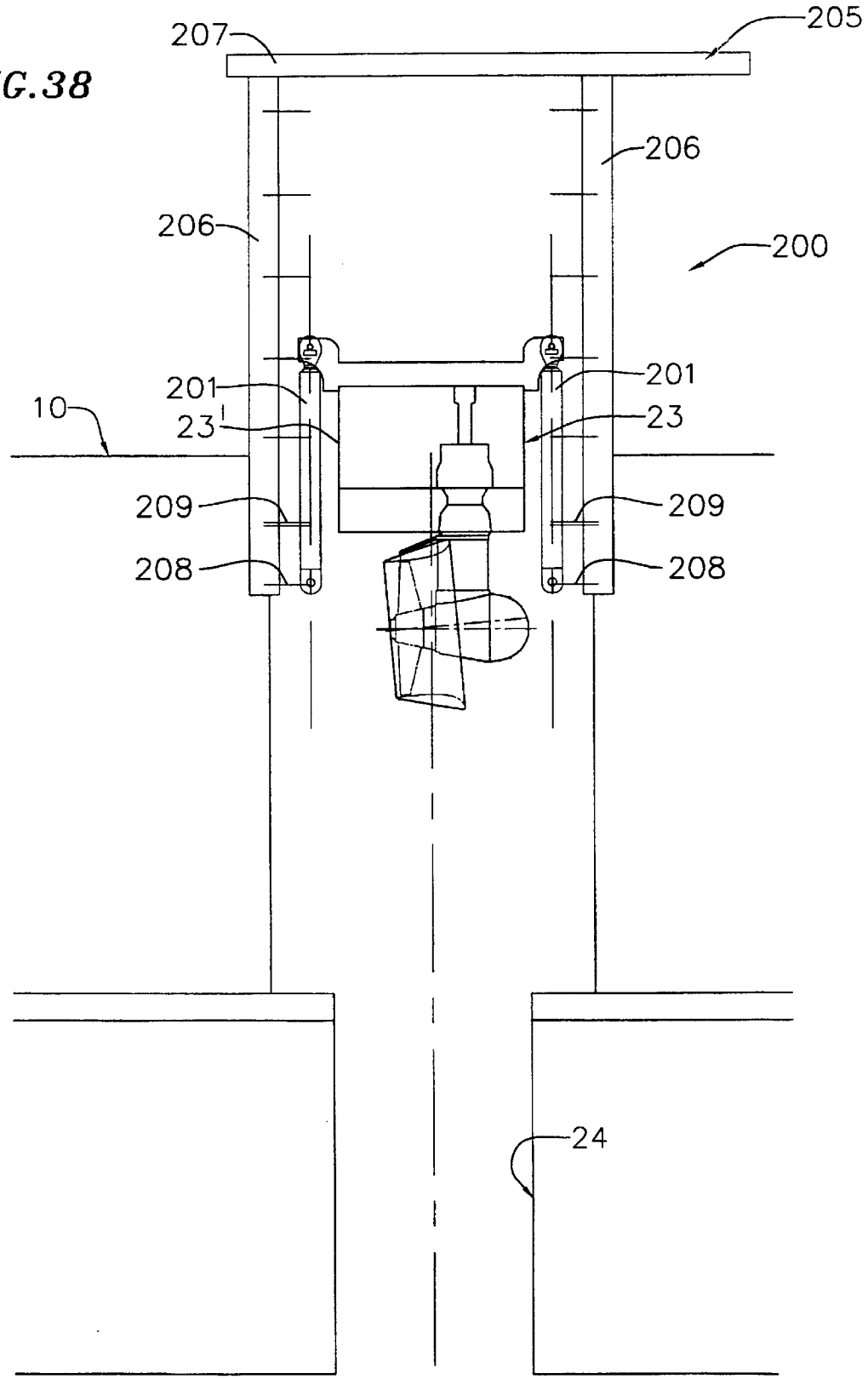
Figure 39:
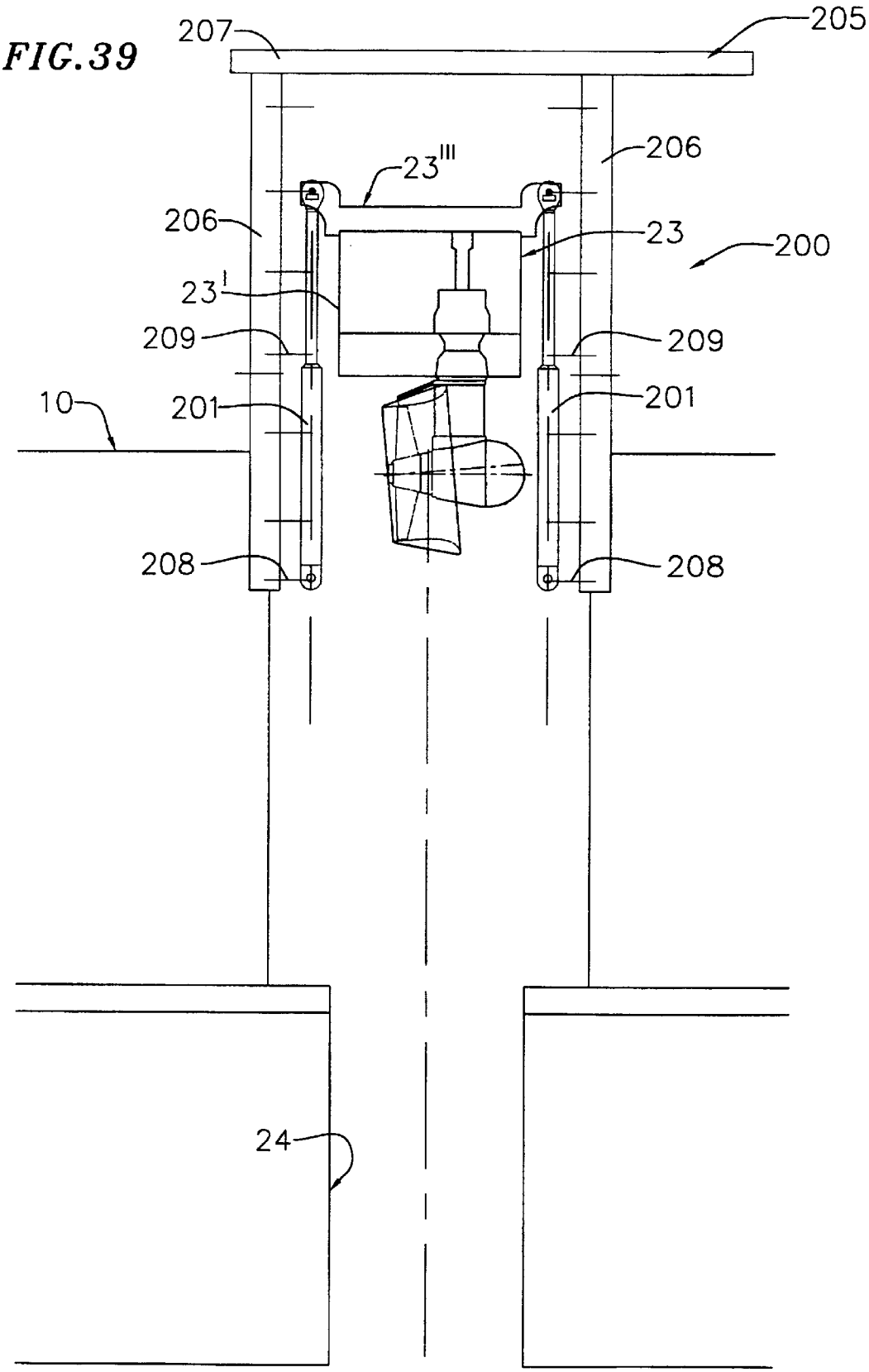
Figure 40:
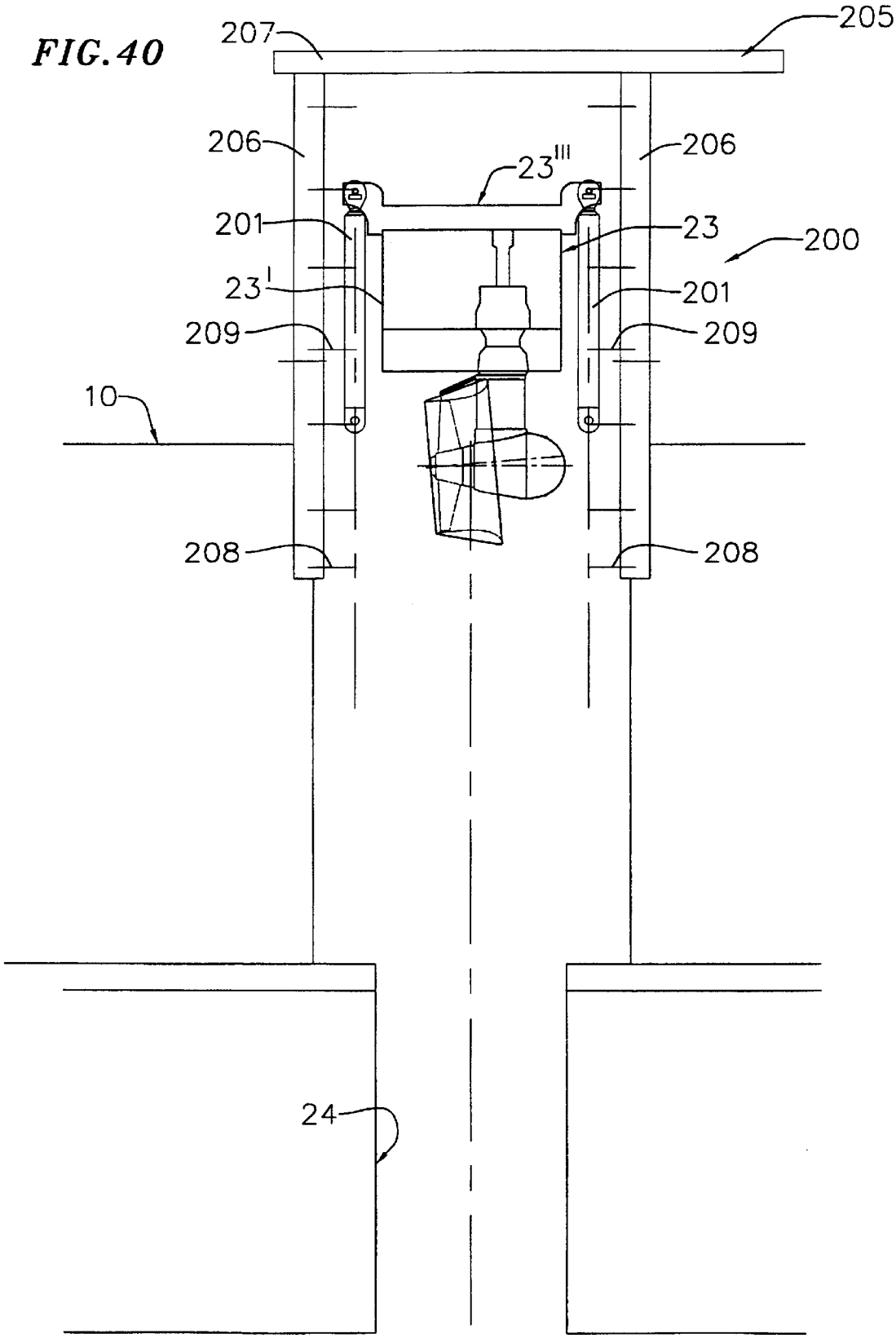
Figure 41:
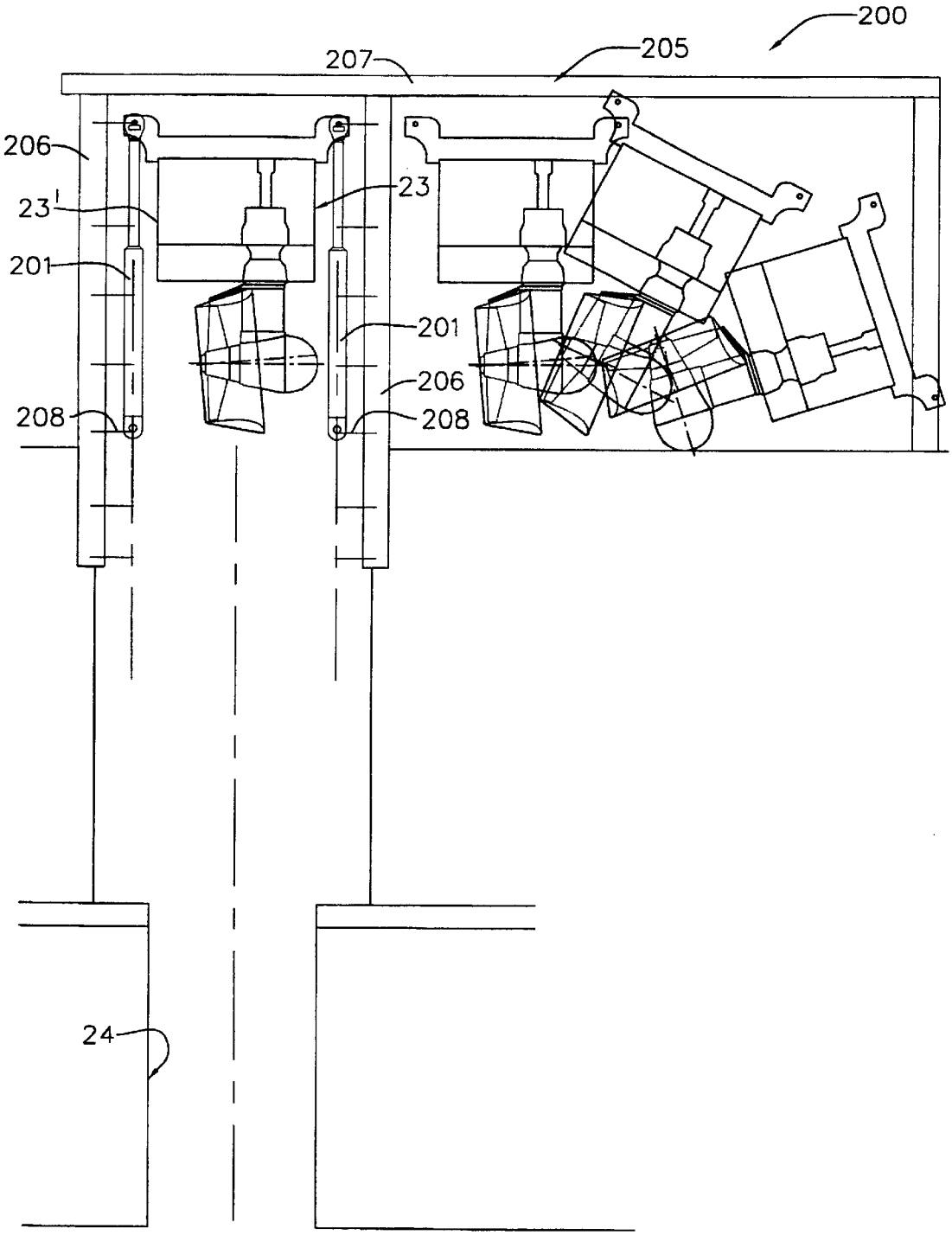

FIGS. 33–41 pertain to a thruster canister which is modular in nature, i.e., is defined by vertically stacked sections which can be disconnected from each other. For example, the lowermost module 23' of a thruster can be composed of the thruster head and the lower chamber of the canister in which the azimuthing steering mechanism for the thruster is located. The next adjacent module 23" of the thruster can be composed of the motor and other compartments. The uppermost module 23"' of the canister can be composed of the structural elements to which the lower ends of rams 201 are connectible. FIGS. 33–41 illustrate different steps in the process of moving such a modular canister to a position of the lower module on the vessel deck by use of rams 201 and the hoisting frame, including removing the central motor module of the canister and connecting the canister hoist module directly to the lower module as shown in FIG. 34.

A drillship having dynamic positioning certification DP2 or DP3 must be able to maintain station in limited weather conditions with one thruster shut down. Drillship 10 is intended to have a DP3 certification. With five of six 5 megawatt steerable thrusters operational, the vessel can maintain station in weather conditions corresponding to a Gulf of Mexico 50 year storm.

When any repairs are needed, the thruster can be removed from and returned to service in the shortest time possible. Time consuming keel hauling of the thruster head assembly from below the hull onto a weather deck and back are avoided, as are diving operations in support of keel hauling or other service procedures addressing a thruster requiring maintenance or repair. Thruster repair or maintenance activities can be pursued while the vessel continues drilling operations or is in transit.

Workers skilled in the art pertinent to this invention will appreciate readily that vertical axis propellers, such as Kirsten-Boeing and Vaith-Schneider propellers, can be used instead of steerable horizontal axis bladed propellers to apply thrust in any desired horizontal direction to a vessel hull. Accordingly, vertical axis propellers as well as steerable horizontal axis propellers as components of a high retraction thruster are within the scope of this invention.

The present invention has been described above in the context of present by preferred and other structural arrangement and procedures which embody and implement the invention. The foregoing description is not intended as an exhaustive catalog of all structural arrangements and procedures embodying the invention, or of contexts in which the invention can be used to advantage. While the presently preferred usage context of the invention is in a drillship, it can be used in other forms of offshore drilling facilities or installations, such as semisubmersible drilling platforms. Also, the invention can be used in other kinds of floating structures, intended for other purposes, which are or may be required to maintain a desired station or to move in any desired horizontal direction with or without a change of heading. Further, variations of or modifications to the structures and procedures described above may be made without departing from the fair scope and content of this invention. For those reasons, the following claims are to be read and interpreted consistently with and in support of that fair scope and content. vertically stacked sections which can be disconnected from each other. For example, the lowermost module 23' of a thruster can be composed of the thruster head and the lower chamber of the canister in which the azimuthing steering mechanism for the thruster is located. The next adjacent module 23" of the thruster can be composed of the motor and other compartments. The 5 uppermost module 23"' of the canister can be composed of the structural elements to which the lower ends of rams 201 are connectible. FIGS. 33–41 illustrate different steps in the process of moving such a modular canister to a position of the lower module on the vessel deck by use of rams 201 and the hoisting frame, including removing the central motor module of the canister and connecting the canister hoist module directly to the lower module as shown in FIG. 34.

A drillship having dynamic positioning certification DP2 must be able to maintain station in limited weather conditions with one thruster shut down. Drillship 10 is intended to have a DP3 certification. With three of six 5 megawatt steerable thrusters operational, the vessel can maintain station in weather conditions corresponding to a Gulf of Mexico 50 year storm.

When any repairs are needed, the thruster can be removed from and returned to service in the shortest time possible. Time consuming keel hauling of the thruster head assembly from below the hull onto a weather deck and back are avoided, as are diving operations in support of keel hauling or other service procedures addressing a thruster requiring maintenance or repair. Thruster repair or maintenance activities can be pursued while the vessel continues drilling operations or is in transit.

Workers skilled in the art pertinent to this invention will appreciate readily that vertical axis propellers, such as Kirsten-Boeing and Voith-Schneider propellers, can be used instead of steerable horizontal axis bladed propellers to apply thrust in any desired horizontal direction to a vessel hull. Accordingly, vertical axis propellers as well as steerable horizontal axis propellers as components of a high retraction thruster are within the scope of this invention.

The present invention has been described above in the context of present by preferred and other structural arrangement and procedures which embody and implement the invention. The foregoing description is not intended as an exhaustive catalog of all structural arrangements and procedures embodying the invention, or of contexts in which the invention can be used to advantage. While the presently preferred usage context of the invention is in a drillship, it can be used in other forms of offshore drilling facilities or installations, such as semisubmersible drilling platforms. Also, the invention can be used in other kinds of floating structures, intended for other purposes, which are or may be required to maintain a desired station or to move in any desired horizontal direction with or without a change of heading. Further, variations of or modifications to the structures and procedures described above may be made without departing from the fair scope and content of this invention. For those reasons, the following claims are to be read and interpreted consistently with and in support of that fair scope and content.

What is claimed is:

1. A method for servicing a propeller drive assembly of a steerable thruster in which the thruster propeller is deployable below a submerged surface of a floating structure, the method comprising the step of raising the thruster vertically in the structure from a deployed position adequately to place the drive assembly at a service location at which the propeller is above the floating waterline of the structure.

2. The method according to claim 1 including the further steps of removing the propeller from the drive assembly at the service location.

3. The method according to claim 2 in which the step of removing the propeller includes the further step of connecting to the propeller in the drive assembly a movable propeller removal tool, and moving the tool with the propeller connected thereto laterally away from the drive assembly.

4. The method according claim 2 in which the service location is within the floating structure.

5. The method according to claim 4 including the step of providing at the service location a propeller removal tool capable of supporting the propeller and a track along which the tool can be moved toward and away from the propeller drive assembly.

6. The method according to claim 5 in which the thruster is movable in a trunk which extends in the structure between a submerged lower end and a closeable hatch at an upper end above the floating waterline, and the step of providing the propeller removal tool and the track at the service location includes moving the tool and the track to the service location through the trunk hatch before raising the thruster in the trunk to place the propeller at the service location.

7. The method according to claim 6 including the further steps, performed after raising the thruster to place the propeller at the service location, of placing the track in alignment with the propeller, engaging the tool with the track for movement along the track, coupling the tool with the propeller in propeller supporting relation, and moving the tool with the propeller coupled thereto along the track to disconnect the propeller from its drive assembly.

8. The method according to claim 7 including placing the track in alignment with the propeller at a position of the track above a floor of the service location.

9. The method of claim 1 in which the service location is on a weather deck of the floating structure, the thruster includes a vertically elongate propeller driver enclosure above the propeller drive assembly, and the thruster is movable in a trunk which extends in the structure between a submerged lower end and a closeable hatch at the weather deck, and including using extensible rams coupled between the enclosure and, as appropriate, the trunk and a trunk extending frame connected to the trunk through the hatch to incrementally raise the propeller drive assembly through the hatch.

10. The method according to claim 9 in which the operation of incrementally raising the propeller drive assembly through the hatch includes disassembling the enclosure.

11. A high retraction steerable thruster for a floating structure which defines a downwardly open, substantially vertical passage in which the thruster is movable to and from a deployed position relative to the structure in which a thruster propeller is submerged below an exterior surface of the structure, characterized in that the passage is defined to enable the thruster to be moved substantially only vertically from its deployed position to a second position at which the propeller is above the floating waterline of the floating structure.

12. A thruster according to claim 11 characterized in that the structure defines a deck adjacent the propeller location at the second position of the thruster and to which the passage opens.

13. A thruster according to claim 12 characterized in that the thruster includes a propeller driver enclosure above the propeller.

14. A thruster according to claim 13 characterized in that the enclosure is disassemblable to accommodate movement of the propeller to the deck.

15. A thruster according to claim 12 characterized in that the deck is located within the structure.

16. A floating marine structure which includes a steerable retractable thruster which is movable in the structure between a lower deployed position in which a propeller of the thruster is disposed below adjacent submerged surfaces of the structure and an upper retracted position in which the propeller is within the structure in a submerged state below the floating waterline of the structure, characterized by a more elevated service position of the thruster in the structure in which the thruster propeller is located above said floating waterline.

17. A floating marine structure according to claim 16 characterized in that the structure is a vessel of shipform configuration.

18. A floating marine structure according to claim 16 characterized in that the structure is equipped as an offshore drilling facility.

19. A floating marine structure according to claim 16 characterized in that the thruster includes an enclosure containing a drive mechanism operable for powering rotation of the propeller and a steering mechanism operable for changing the angular relation between the direction of thrust produced by the propeller and the floating structure, and further characterized by a vertical drive mechanism coupled between the structure and the enclosure operable for moving the thruster between said deployed, retracted and service positions.

20. A floating marine structure according to claim 19 characterized in that the vertical drive mechanism is powered from within the enclosure.

21. A floating marine structure according to claim 20 characterized in that the vertical drive mechanism includes a rack carried by the structure and a pinion gear meshed with the rack and carried by the enclosure.

22. A floating marine structure according to claim 19 characterized by a seal engagable between a lower extent of the enclosure and the structure in the deployed position of the thruster.

23. A floating marine structure according to claim 22 characterized by a downwardly open trunk in the structure in which the thruster enclosure is vertically movable to and between said positions, and the seal is engagable substantially at the lower end of the trunk about the enclosure.

24. A floating marine structure according to claim 23 characterized in that the enclosure is lockable to the trunk in the deployed and retracted positions of the thruster.

25. A floating marine structure according to claim 23 characterized in that the trunk is laterally enlarged adjacent the location of the propeller in the service position of the thruster.

26. A floating marine structure according to claim 23 characterized by service decking positionable in the trunk adjacent the location of the propeller in the service position of the thruster.

27. A floating marine structure according to claim 16 characterized by a closable opening in the structure through which an upper portion of the thruster extends in the service position of the thruster in the structure.

28. A floating marine structure, such as an offshore drilling facility, having a hull in which there is a retractable steerable thruster, the thruster having a propeller carried by and below a vertically movable enclosure which includes a driver for the propeller, the floating structure including, among other components, a vertical trunk in the hull in which the thruster driver enclosure is vertically movable, the trunk extending from a submerged lower open end to a level in the hull above the floating waterline of the structure at which at least one wall of the trunk opens to a thruster service space, and a thruster vertical travel system effectively coupled between the structure and the thruster and operable for moving the thruster vertically between a deployed position of the thruster in which the propeller is below the trunk lower end and an elevated position in which the propeller is above said level.

29. A floating marine structure according to claim 28 in which said level is at a weather deck of the hull.

30. A floating marine structure according to claim 28 in which said level is within the structure.

31. A floating marine structure according to claim 28 in which the trunk includes a closeable top hatch at a weather deck of the structure.

32. A floating marine structure according to claim 28 in which the thruster service space has sufficient dimension laterally and vertically relative to the trunk that the propeller can be removed from the thruster and placed in the space.

33. A floating marine structure according to claim 32 including, at the space, equipment for disconnecting and reconnecting the propeller from and to the thruster.

34. A floating marine structure according to claim 28 in which the thruster vertical travel system is operatively coupled between the thruster enclosure and the trunk.

35. A floating marine structure according to claim 34 in which the thruster vertical travel system includes a vertical rack carried on a wall of the trunk and a pinion meshed with the rack, carried by the thruster enclosure, and driven from within the enclosure.

36. A floating marine structure according to claim 28 in which at least a lower portion of the thruster enclosure is substantially watertight, and in which the lower end of the enclosure is substantially at the open lower end of the trunk in the deployed position of the thruster.

37. A floating marine structure according to claim 36 including a structural support frame for the thruster enclosure circumferentially of the trunk lower end opening and which the enclosure contacts in the deployed position of the thruster.

38. A floating marine structure according to claim 37 including a seal engageable between the thruster enclosure and the support frame substantially upon contact of the enclosure with the support frame.

39. A floating marine structure according to claim 38 including a depending skirt circumferentially of the thruster enclosure at its lower end and via which the enclosure contacts the support frame, and in which the seal is disposed inside the skirt.

40. A floating marine structure according to claim 36 in which the perimeter of the trunk lower end opening is defined substantially in a common plane.

41. A floating marine structure according to claim 40 in which said common plane is substantially parallel to a base plane of the structure.

42. A floating marine structure according to claim 40 in which the hull molded surface circumferentially of the trunk is not in said common plane at all locations about the trunk, and including an appendage on the hull defining such a portion of the opening perimeter as is adequate in relation to the molded surface to cause the opening perimeter to be substantially in the common plane.

43. A floating marine structure according to claim 41 in which the common plane is substantially in the base plane.

44. A floating marine structure according to claim 43 in which the propeller is designed to produce a high level of bollard pull.

45. A floating marine structure according to claim 41 in which the common plane is sufficiently above the base plane that the propeller of the deployed thruster does not extend significantly below the base plane.

46. A floating marine structure according to claim 45 in which the propeller is designed for best efficiency when the structure is moving at a selected velocity meaningfully greater than zero velocity.

47. A floating marine structure according to claim 28 in which the propeller has a substantially horizontal axis of rotation.

48. A floating marine structure according to claim 28 in which the thruster has an intermediate retracted position in the trunk at which the propeller is at least partially submerged and is above the lower end of the trunk.

49. A floating marine structure according to claim 48 including thruster position keeping means cooperable between the hull and the thruster and selectively operable for securing the thruster in its deployed, intermediate retracted, and elevated positions.

50. A floating marine structure according to claim 49 in which the thruster position keeping means includes lock pins releasably engagable between the hull and the thruster enclosure.

51. A floating marine structure according to claim 50 in which the pins are retractably carried by the enclosure.

52. A floating marine structure according to claim 51 including a mechanical latch engagable with each lock pin in the engaged state of the pin with hull for securing the lock pin in its engaged state.

53. A floating marine structure according to claim 51 in which there is a lock pin at each of three locations spaced about the circumference of the enclosure.

54. A floating marine structure according to claim 50 in which the lock pins are engagable between the hull and the thruster enclosure at the deployed and retracted positions of the thruster.

55. A floating marine structure according to claim 50 in which the lock pins and receiver therefor associated with the deployed position of the thruster are configured and defined for transfer of thrust developed by operation of the thruster to the floating structure.

* * * * *

UNITED STATES PATENT AND TRADEMARK OFFICE

CERTIFICATE OF CORRECTION

PATENT NO. : 6,439,936 B1 
DATED : August 27, 2002
INVENTOR(S) : Mark William Dreith and Darryl Scott Brittin It is certified that error appears in the above-identified patent and that said Letters Patent is hereby corrected as shown below:

Title page,
Item [60], insert
-- Related U.S. Application Data
[60] Provisional application No. 60/121,812, filed on Mar. 3, 1999. --.

Signed and Sealed this

Twenty-fifth Day of March, 2003

JAMES E. ROGAN
*Director of the United States Patent and Trademark Office*